US008390262B2

(12) United States Patent
Chang et al.

(10) Patent No.: US 8,390,262 B2
(45) Date of Patent: Mar. 5, 2013

(54) METHODS AND CIRCUITS FOR LED DRIVERS AND FOR PWM DIMMING CONTROLS

(75) Inventors: Ronald Chang, Fremont, CA (US); Chin-Chi Chang, Fremont, CA (US); Chung-Kuang Huang, Sunnyvale, CA (US)

(73) Assignee: LePower Semiconductor Inc., San Jose, CA (US)

( * ) Notice: Subject to any disclaimer, the term of this patent is extended or adjusted under 35 U.S.C. 154(b) by 253 days.

(21) Appl. No.: 12/620,589

(22) Filed: Nov. 17, 2009
(Under 37 CFR 1.47)

(65) Prior Publication Data

US 2010/0289424 A1 Nov. 18, 2010

Related U.S. Application Data

(60) Provisional application No. 61/115,536, filed on Nov. 17, 2008.

(51) Int. Cl.
*G05F 1/00* (2006.01)

(52) U.S. Cl. ..... 323/282; 323/285; 323/222; 315/250; 315/291; 315/209 R

(58) Field of Classification Search ..... 315/185 R, 315/250, 291, 294, 297, 307, 209 R; 323/234, 323/282, 285, 280, 265, 222, 259
See application file for complete search history.

(56) References Cited

U.S. PATENT DOCUMENTS 7,868,603 B2 * 1/2011 Lacombe et al. ..... 323/285
2008/0068298 A1 * 3/2008 Shen et al. ..... 345/46
2010/0013395 A1 * 1/2010 Archibald et al. ..... 315/185 R

OTHER PUBLICATIONS

Maxim, "Six-String White LED Driver with Active Current Balancing for LCD Panel Applications," product specification, Oct. 2007.
Intersil Americas Inc., "8-Channel LED Driver," product specification, May 9, 2008.

* cited by examiner

*Primary Examiner* — Douglas W Owens
*Assistant Examiner* — Jonathan Cooper
(74) *Attorney, Agent, or Firm* — Venture Pacific Law, PC

(57) ABSTRACT

The present invention relates to methods for LED driver applications, comprising the steps: providing an input voltage, $V_{in}$; generating an output voltage, $V_{out}$, for driving a plurality of LED channels, wherein a boost converter is used to convert the input voltage $V_{in}$ to the output voltage $V_{out}$; determining a lowest voltage, $V_{LVS}$, from the LED channels; generating a comparator voltage, $V_{comp}$, by comparing the lowest voltage of the channels, $V_{LVS}$, with a feedback reference voltage, $V_{FBREF}$, wherein the feedback reference voltage, $V_{FBREF}$, and a LED current, $I_{LED}$, for the LED channels are determined by a current $I_{SET}$; generating a summed voltage, $V_{sum}$, for stabilizing the output voltage, $V_{out}$; and generating a PWM voltage, $V_{PWM}$, as a function of the $V_{comp}$ and the $V_{sum}$ to control the output voltage, $V_{out}$.

20 Claims, 25 Drawing Sheets

METHODS AND CIRCUITS FOR LED DRIVERS AND FOR PWM DIMMING CONTROLS

CROSS REFERENCE

This application claims priority from a provisional patent application entitled "Methods and Systems for LED Drivers and for PWM Dimming Controls" filed on Nov. 17, 2008 and having an Application No. 61/115,536. Said application is incorporated herein by reference.

FIELD OF INVENTION

This invention relates to methods and circuits for light emitting diode ("LED") drivers, and, in particular to, methods for pulse-width modulation ("PWM") dimming controls for LEDs of a display.

BACKGROUND

Low-end displays typically require only monochromatic LEDs. Applications include simple sporting scoreboards, single-line scrolling displays, and transportation road signs. A newer and growing market for high-quality video displays requires the capability to play full-motion video shown in millions of colors. These applications include ever-expanding advertising markets encompassing convenience stores, retail shops, gas stations, and stadiums.

An emerging market for LEDs is in DLP-based televisions and LCD-based televisions. Accurate color reproduction by these televisions is dependent on the available colors of the televisions' backlight. Proper control of red LEDs, green LEDs, blue LEDs (collectively referred to as RGB LEDs), and white LEDs ("WLEDs") produce a color spectrum that is larger than the NTSC color spectrum for television broadcasts. By contrast, the backlighting of a cold cathode fluorescent lamp ("CCFL") produces about 85% of the NTSC color spectrum.

Thus, sophisticated LED drivers capable of providing multiple brightness levels are required. The number of colors available in the display is proportional to the number of brightness levels available for each of the RGB LEDs that make up a single pixel in an overall display. Competition between display manufacturers is driving designers toward high-end LED drivers with integrated PWM functionality capable of delivering thousands of brightness levels. An increased number of brightness levels can enhance color shading and improve video quality.

High-quality, full-color video requires hundreds or thousands of brightness levels between 0% and 100%. Older LED drivers use analog dimming circuits to provide these brightness levels. Analog dimming circuits alter the brightness of a LED display by adjusting the forward electric current of the LEDs. For example, if an LED is at full brightness with 20 mA of forward current, then 25% brightness is achieved by driving the LED with 5 mA of forward current. While this dimming scheme is simple and works well for lower-end displays, a substantial drawback with analog dimming is that an LED's color shifts with changes in forward current.

Pulse width modulation ("PWM") dimming can be used to adjust LED brightness levels while maintaining superior color quality. This technique is also referred to as PWM gray scaling. PWM dimming is achieved by applying a maximum forward current for maximum brightness at a reduced duty cycle. In other words, the LED's brightness is controlled by adjusting the relative ratios of an amount of time that an LED is on to an amount of time that the LED is off. A 25% brightness level is achieved by turning the LED on at maximum forward current for 25% of each duty cycle period. To avoid display flicker, the switching speed must be greater than 60 Hz. Above 60 Hz, the human eye averages the LED's on-time and the LED's off-time, seeing only an effective brightness that is proportional to the LED's on-time duty cycle. An advantage of PWM dimming is that the forward current is always constant. Therefore, the LED's color does not vary since the brightness level does not vary, as is the case with analog dimming schemes. Furthermore, precise brightness levels can be achieved while preserving the color purity by switching the LED off and on.

Since this type of PWM dimming is microprocessor-driven, it is limited to a maximum number of discrete brightness levels for each LED, commonly referred to as grayscale steps. The total available number of discrete steps during any one period determines the LED's brightness resolution. High-quality displays require hundreds to thousands of brightness levels to accurately reproduce the full color spectrum necessary for full-motion video.

Unfortunately, PWM dimming controls have other problems for displaying images. For instance, FIG. 1*a* illustrates a prior art circuit for driving a plurality of diodes in parallel using a PWM dimming control. Due to non-ideal variations for each diode, the I-V characteristics of each diode may vary. Therefore, the current across each diode ($I_1$, $I_2$, $I_3$, and $I_4$) may be different. Thus the brightness level of each diode may not be matched to each other (i.e., the brightness levels of the diodes are not the same). This can lead to uneven brightness on the respective display that houses the diodes.

FIG. 1*b* illustrates another prior art circuit for driving a plurality of diodes in series using a PWM dimming control circuit. The brightness levels of the diodes will be similar since the current, $I_5$, is the same over each diode. Thus the brightness level of a diode will be matched with the brightness levels of the other diodes. However, this implementation is costly and does not allow for multiple channels of diodes.

FIG. 1*c* illustrates a prior art circuit for driving a plurality of diodes using a PWM dimming controller, where a voltage feed back loop is connected to the PWM dimming controller and a single channel. The voltage feed back loop is used to match the current over one channel. However, the implementation of this display may lead to uneven brightness levels for the other channels since the diodes in other channels are not fed back to the PWM dimming control block.

FIG. 1*d* illustrates a prior art circuit for driving a plurality of diodes using a PWM dimming controller, where a current balancer module is used to select a feed back voltage from a plurality of channels. A current balancer is used to detect the various voltages on each channel, and feed back these voltages to a PWM dimming control to adjust the current over each channel. A drawback of this design is that the current balancer and the PWM dimming controller are two separate circuits; thus leading to time lag, increased implementation complexity, and inefficient power consumption. Furthermore, existing prior art methods for the current balancer have a very large error rate of 10 percent or more.

FIG. 1*e* illustrates a prior art circuit for driving a plurality of diodes using a PWM dimming control, where a PWM dimming control and a current balancer are integrated in one block. Although this design is more advantageous in certain respects than the previous example, implementation complexity is still not optimized and the current balancing integrated module can have a relatively high error rate of 10 percent or more.

Therefore, it is desirable to provide methods for PWM dimming controls for LEDS, where respective currents for each channel of diodes are matched to maintain even display brightness at a very low error rate.

Another problem with PWM dimming controls is that the currents over the LED channels are not matched due to variations of the resistors of the current source. FIG. 1*f* illustrates a prior art method for current sources for driving a plurality of LED channels. In a current source 1, a channel $V_{CH1}$ is connected to an operational amplifier via a transistor. A voltage applied on the negative input of the operational amplifier can be denoted $V_{FB1}$. A voltage applied at the source drain of the transistor 802 can be denoted $V_{CS1}$. This nomenclature can be extended to a current source 2 (e.g. $V_{FB2}$ and $V_{CS2}$), and so forth for the other current sources since schematically all the current sources are substantially similar. Each current source drives a single channel of LEDs.

There can be at least three resistances for each current source (e.g. in the current source 1, a resistance due to an operational amplifier, $R_{CSREF}$, and $R_{CS1}$). These resistances must be matched with other current sources to generate an accurate current through the channel. However, prior art methods do not effectively match these three resistances, thus the currents in the plurality of channels may not be accurately matched to one another. Therefore, methods for improved current matching over a plurality of channels are required. This is especially true when the channels comprise of LEDs since current matching is of particular importance to maintain the same brightness level for the LEDs of different channels.

FIG. 1*g* illustrates another prior art method for channel matching, where only one $R_{CSEF}$ is used for a plurality of current sources. Here, for each current source only an operational amplifier and a resistor (e.g. $R_{CS1}$) need to be matched. Current mismatch comes from mismatch between $\{R_{CS1}, R_{CS2}\}$, $\{V_{CSREF1}, V_{FB1}\}$. However, this also results in inaccurate currents because $R_{CS1}, R_{CS2} \ldots R_{CS8}$ are generally not physically laid out close together. Therefore, methods for channel matching are required that can produce accurately matched currents over the plurality of channels.

Yet another problem related to PWM dimming controls circuits is generating a compensating ramp signal for a power converter circuit. Conventional current-mode controlled DC to DC converters operating above 50% duty cycle need a compensating ramp signal superimposed on a current sense signal, which is used as a control parameter, to avoid open loop instability and sub-harmonic oscillation problems.

In a typical voltage mode boost converter, an inductor is placed between a power supply and the drain of a switching transistor. A diode is coupled between the common inductor/drain terminal and the output of the converter. As the switching transistor is turned on and off under the control of a pulse width modulator, the inductor is energized with a current which flows through the inductor and switching transistor to ground, thus storing energy in the core of the inductor in the form of a magnetic flux. When the switching transistor is turned off, current continues to flow through the inductor. As the magnetic flux field collapses, a voltage appears across the inductor which is delivered through a diode to the load. Typically, a large capacitor is placed across the output of the converter to hold the converter output voltage at a predetermined level during the periods when the switching transistor is charging the inductor.

In a voltage controlled converter, the voltage appearing at the load is sensed by an error amplifier. The error amplifier generates an error voltage which is related to the voltage appearing at the output of the converter. Minute changes in voltage appearing at the output of the converter are changed to relatively larger voltage swings by the error amplifier. The output of the error amplifier is coupled to one terminal of a comparator which has another terminal coupled to a compensating ramp signal. A current sensing circuit may generate the ramp signal as a function of the current from the inductor. As the voltage appearing at the output of the error amplifier rises and falls with respect to the compensating ramp signal, the output of the comparator changes state in a pulse-width modulated waveform. This signal is coupled to the switching transistor to effect the switching thereof and complete the regulator loop.

However, it remains an ongoing goal to generate a compensating ramp signal to optimize the stability of the power converting circuit. In addition, it remains an ongoing goal to increase the accuracy for sensing the inductor current since switches such as MOSFETS have process variation (e.g., based on temperature) which can cause inaccuracies during voltage measurements.

SUMMARY OF INVENTION

An object of this invention is to provide methods for PWM dimming control of LEDs, where respective currents for each LED channel are matched to one another.

Another object of this invention is to provide methods for PWM dimming control of LEDs, where the brightness level of any channel of the LEDs is matched to within a certain brightness level of other channels of the LEDs.

Yet another object of this invention is to provide current sense and artificial ramp circuits for a PWM dimming control.

Briefly, the present invention relates to methods for LED driver applications, comprising the steps: providing an input voltage, $V_{in}$; generating an output voltage, $V_{out}$, for driving a plurality of LED channels, wherein a boost converter is used to convert the input voltage $V_{in}$ to the output voltage $V_{out}$; determining a lowest voltage, $V_{LVS}$, from the LED channels; generating a comparator voltage, $Vc_{omp}$, by comparing the lowest voltage of the channels, $V_{LVS}$, with a feedback reference voltage, $V_{FBREF}$, wherein the feedback reference voltage, $V_{FBREF}$, and a LED current, $I_{LED}$, for the LED channels are determined by a current $I_{SET}$; generating a summed voltage, $V_{sum}$, for stabilizing the output voltage, $V_{out}$; and generating a PWM voltage, $V_{PWM}$, as a function of the $V_{comp}$ and the $V_{sum}$ to control the output voltage, $V_{out}$.

An advantage of this invention is that the methods for PWM dimming control of LEDs are provided, where the respective current for each diodes are matched.

Another advantage of this invention is that methods for PWM dimming control of LEDs are provided, where the brightness level of any channel of the LEDs is matched to within a certain level of the other channels of the LEDs.

Yet another advantage of this invention is that current sense and artificial ramp circuits for a PWM dimming control are provided to improve current sensing.

DESCRIPTION OF THE DRAWINGS

The foregoing and other objects, aspects, and advantages of the invention will be better understood from the following detailed description of the preferred embodiment of the invention when taken in conjunction with the accompanying drawings in which.

The foregoing and other objects, aspects, and advantages of the invention will be better understood from the following detailed description of the preferred embodiment of the invention when taken in conjunction with the accompanying drawings in which.

DETAILED DESCRIPTION OF THE PREFERRED EMBODIMENTS

Figure 1A:
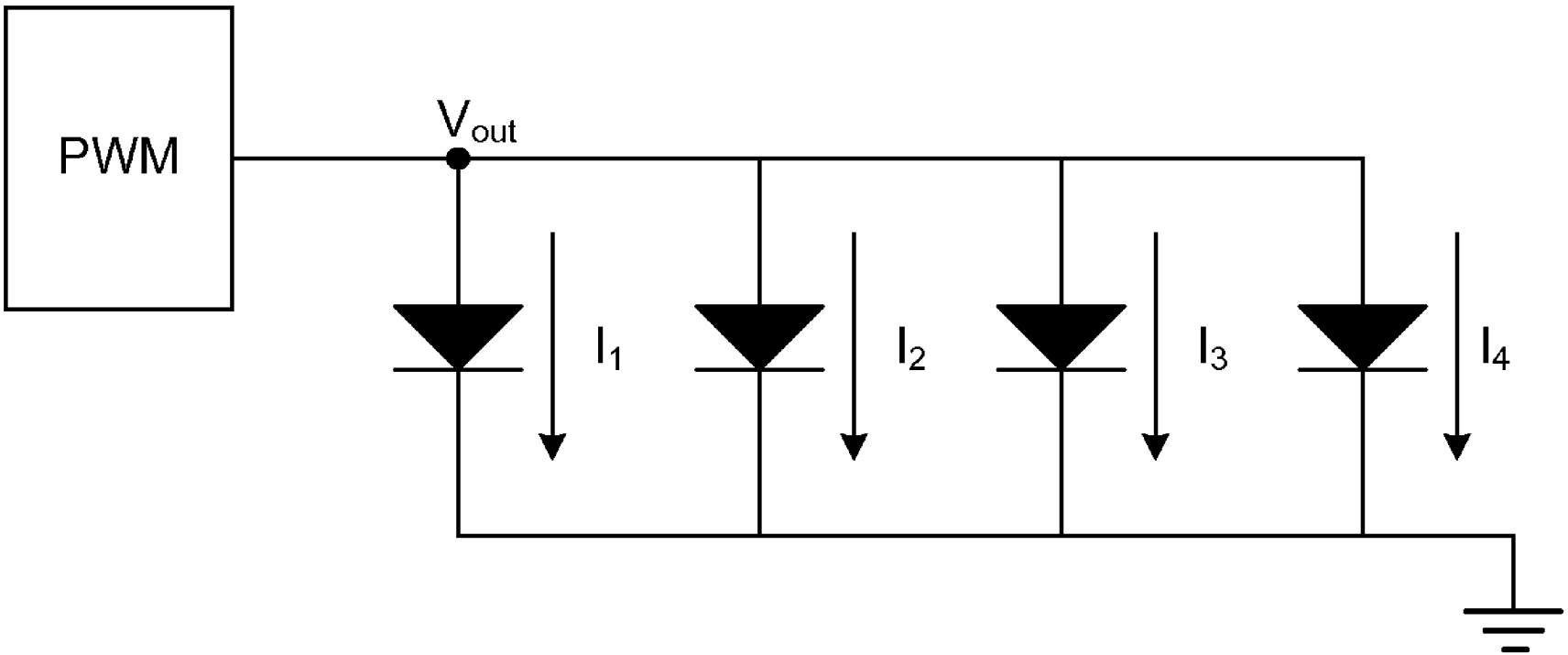
Fig. 1a (Prior Art)
FIG. 1*a* illustrates a prior art circuit for driving a plurality of diodes in parallel using a PWM dimming control.
Figure 1B:
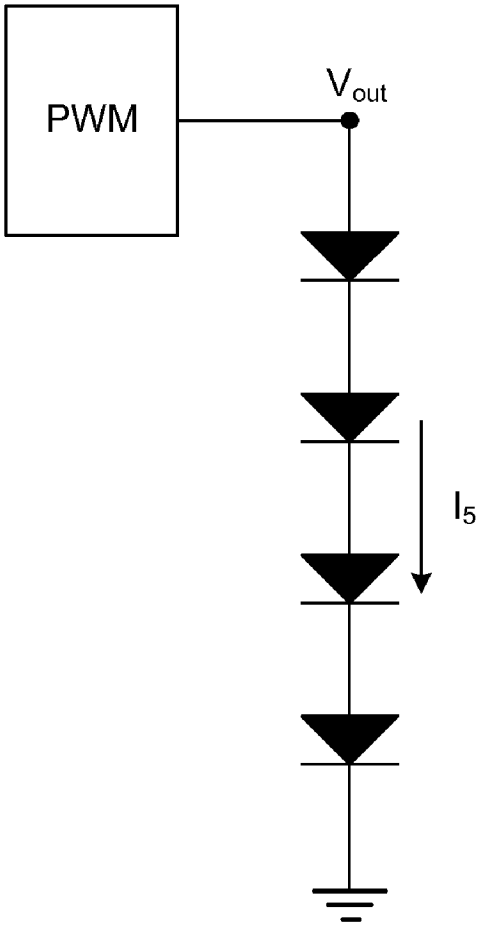
Fig. 1b (Prior Art)
FIG. 1*b* illustrates a prior art circuit for driving a plurality of diodes in series using a PWM dimming control.
Figure 1C:
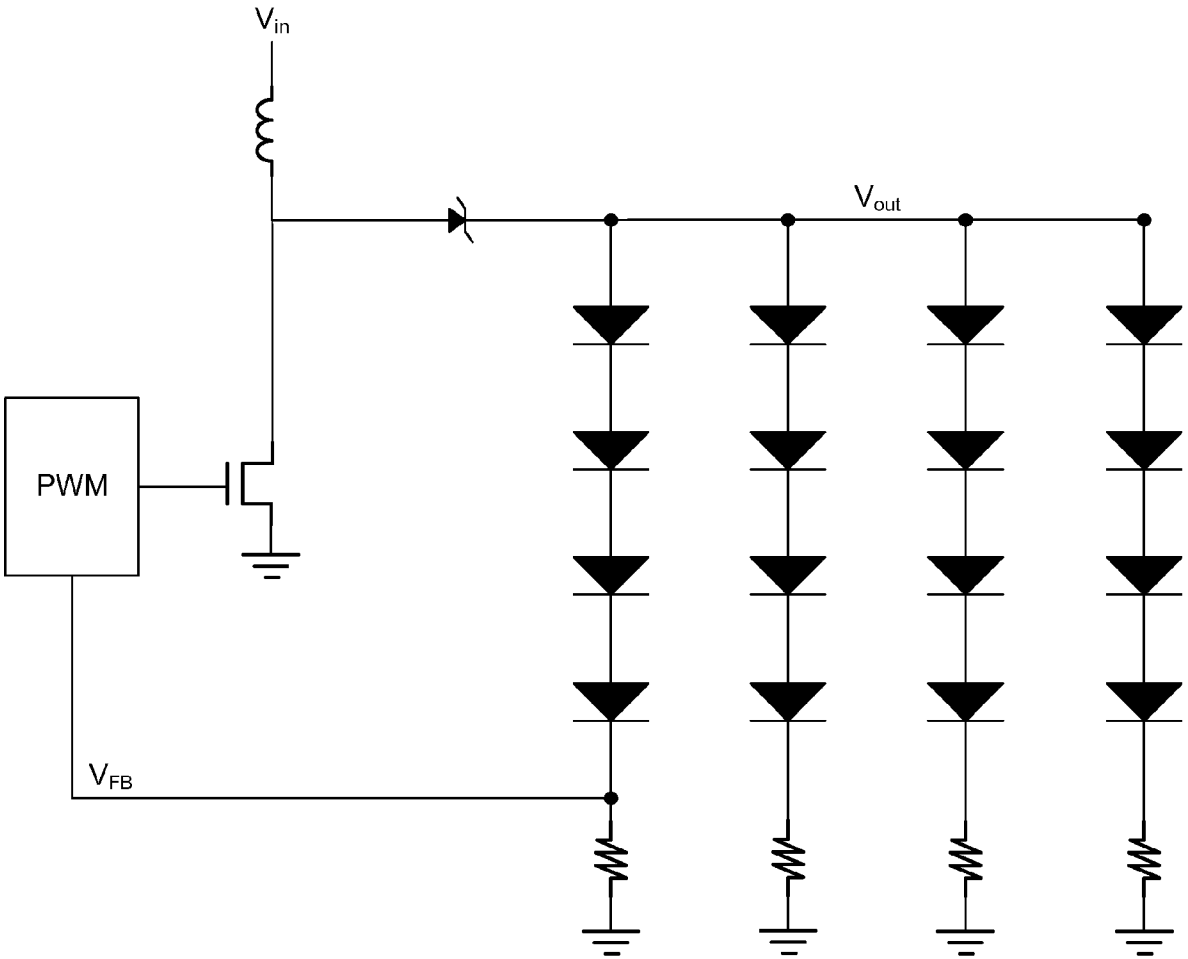
Fig. 1c (Prior Art)
FIG. 1*c* illustrates a prior art circuit for driving a plurality of diodes using a PWM dimming control, where a voltage feed back loop is connected to the PWM dimming control and a single channel.
Figure 1D:
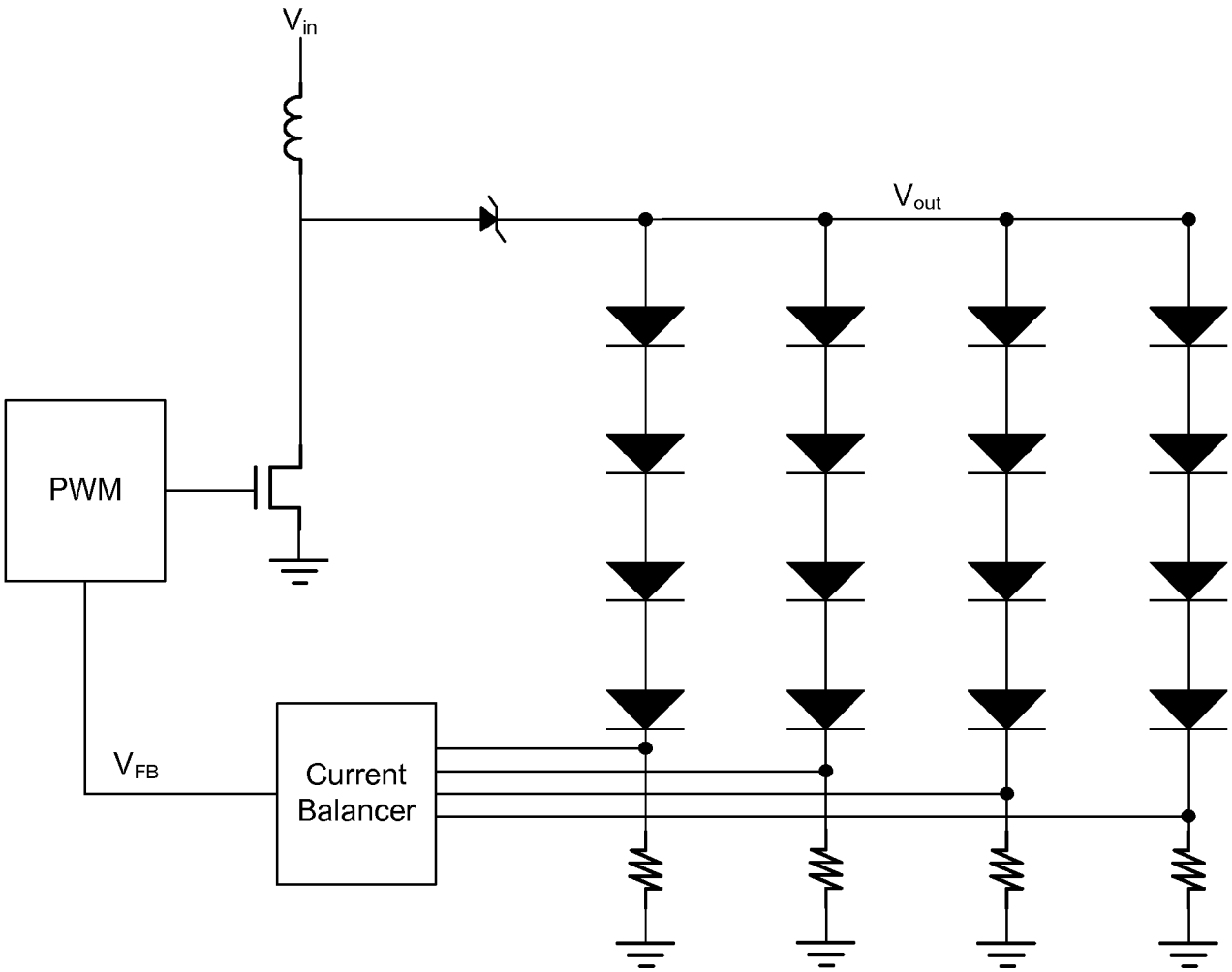
Fig. 1d (Prior Art)
FIG. 1*d* illustrates a prior art circuit for driving a plurality of diodes using a PWM dimming control, where a current balancer module is used to select a feed back voltage from a plurality of channels.
Figure 1E:
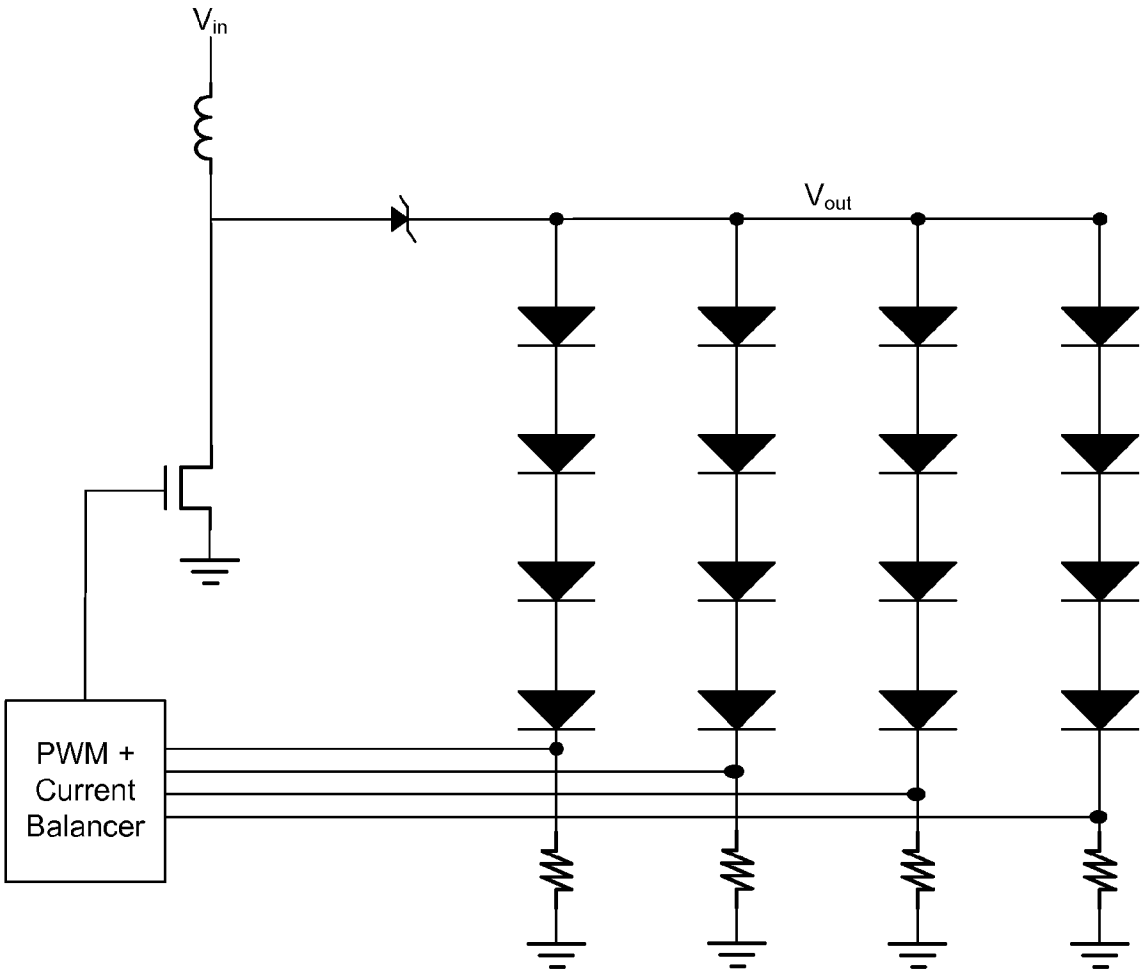
Fig. 1e (Prior Art)
FIG. 1*e* illustrates a prior art circuit for driving a plurality of diodes using a PWM dimming control, where a PWM dimming control and a current balance are integrated in one block.
Figure 1F:
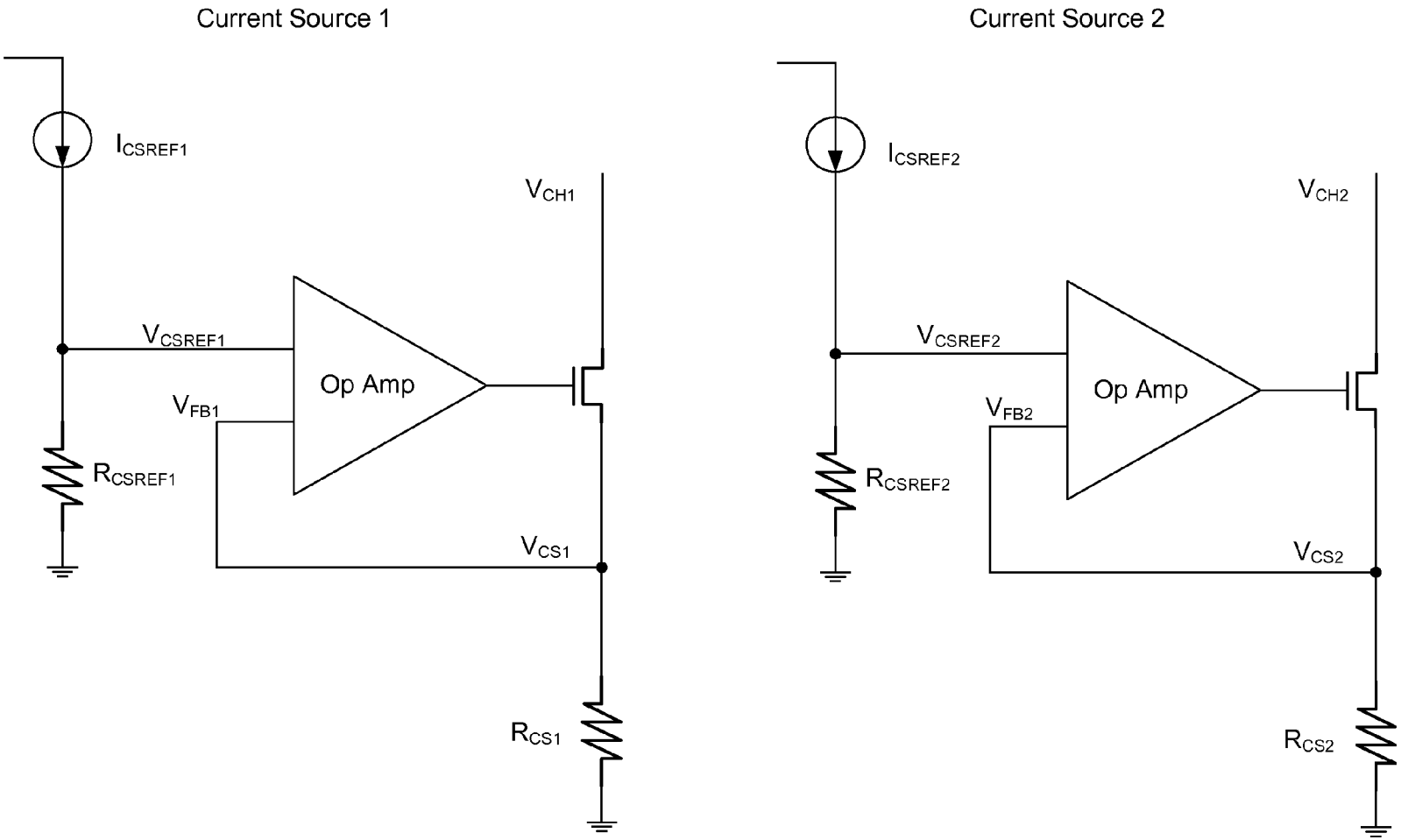
Fig. 1f (Prior Art)
FIG. 1*f* illustrates a prior art method for current sources for driving a plurality of LED channels.
Figure 1G:
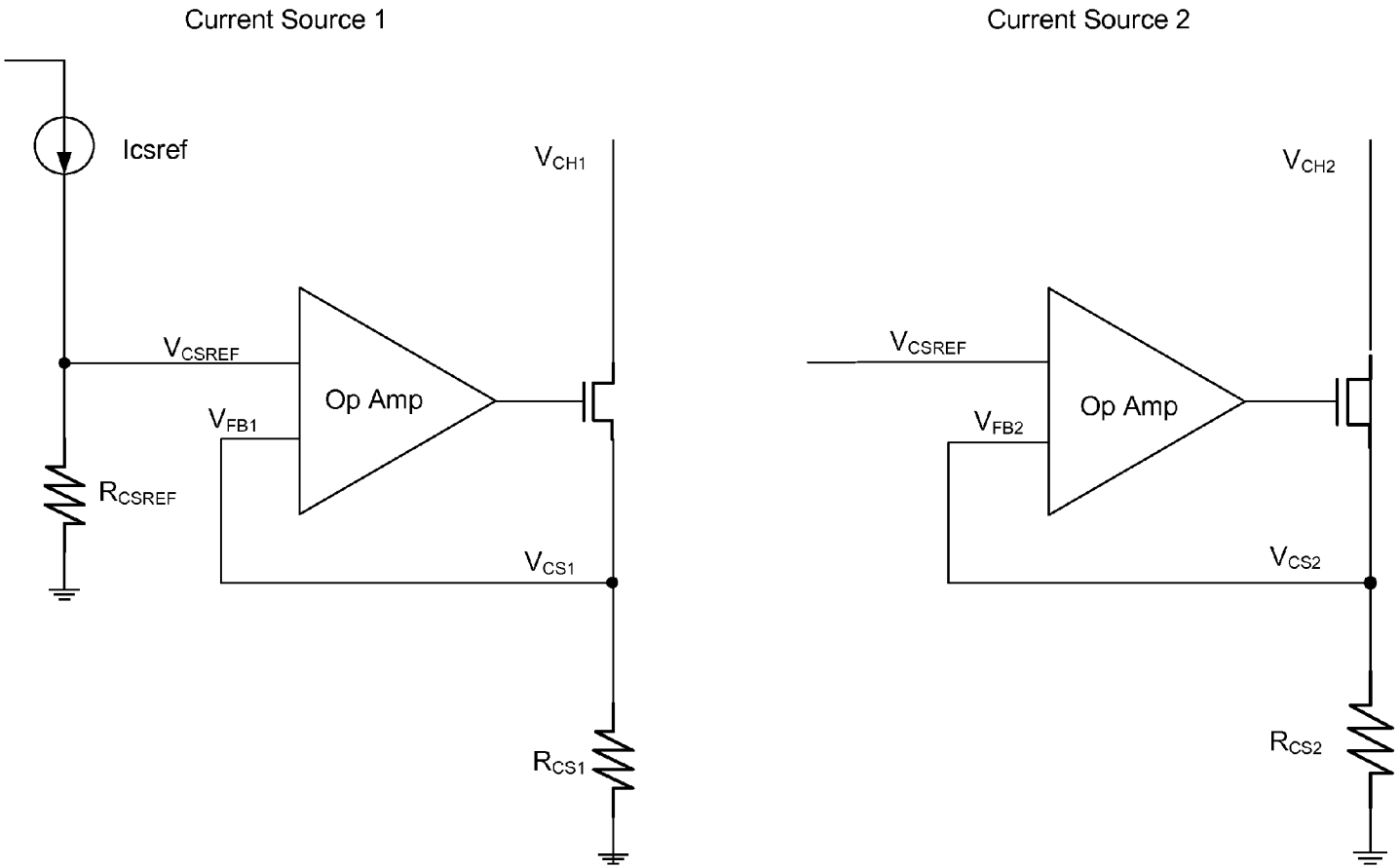
Fig. 1g (Prior Art)
FIG. 1*g* illustrates another prior art method for channel matching, where only one RCSEF is used for a plurality of current sources.
Figure 2:
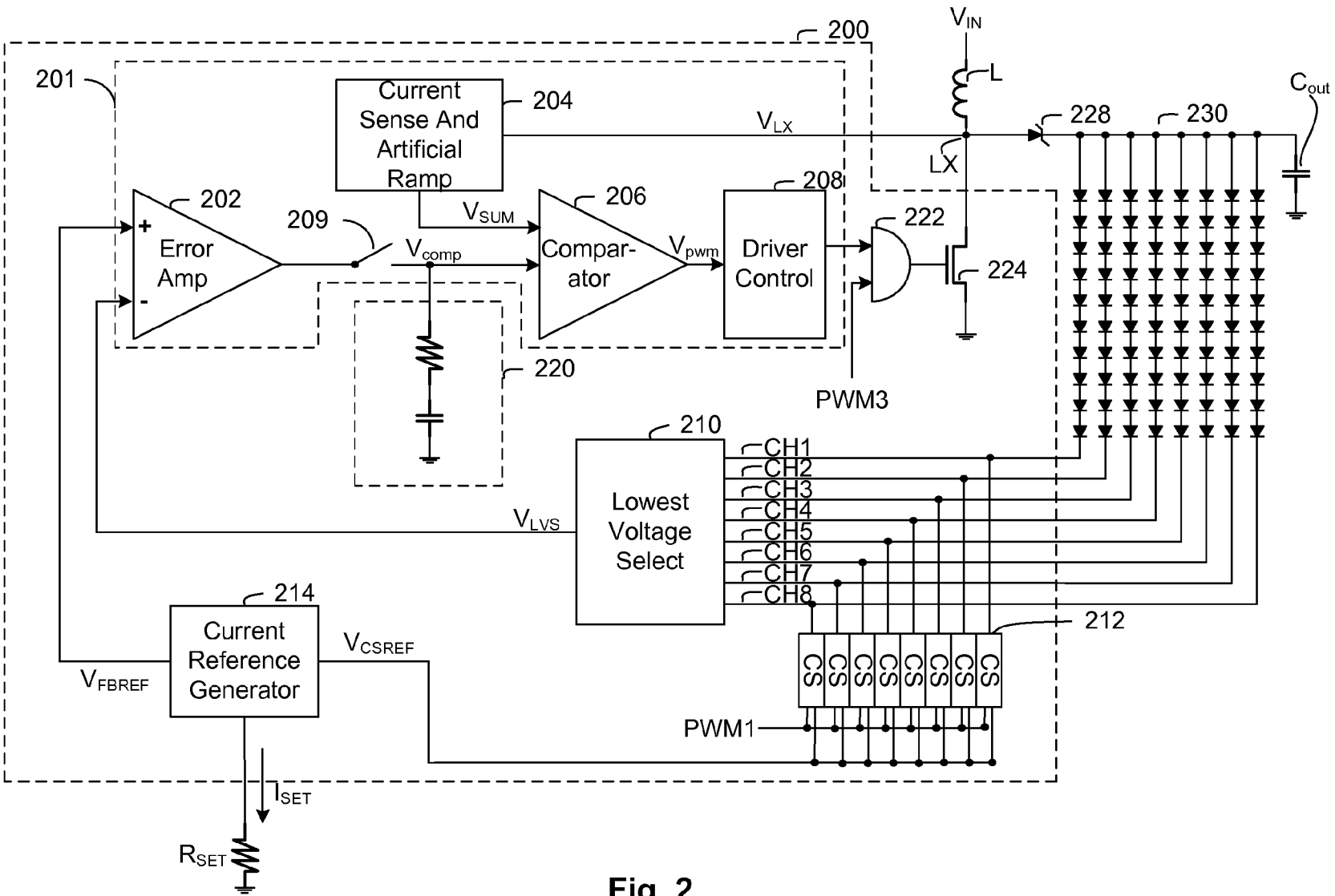
FIG. 2 illustrates a PWM dimming control circuit of this invention for driving a plurality of diodes.

FIG. 2 illustrates a PWM dimming control circuit of the present invention for driving a plurality of diodes. A PWM dimming control circuit 200 is integrated with a boost converter 201, where the boost converter is connected to eight channels (wherein each channel can be denoted CH1, CH2, CH3, CH4, CH5, CH6, CH7, and CH8, respectively). Each channel has a plurality of LEDs connected in series, where the LEDs of each channel are forward biased in the same direction along the channel.

In this example, there are eight channels, but it will be appreciated by an average engineer in this field that the present invention can be implemented using any number of channels. It can also be appreciated that the present invention can be implemented using equivalent circuits and/or components to those taught in the following disclosure. Furthermore, for simplicity, identical reference numbers and reference characters in the various figures may denote similar structures or similar variable values.

The PWM dimming control circuit 200 comprises a boost controller 201, an and-gate 222 to drive the gate of a n-channel ("metal oxide semiconductor field effect transistor") MOSFET 224, a lowest voltage select circuit 210, a current source 212 for each of the channels, and a current reference generator 214. To simplify the description of this invention, an n-channel MOSFET may be simply described as a MOSFET, unless otherwise stated (e.g. as a p-channel MOSFET). Furthermore, it will be appreciated that an n-channel MOSFET and a p-channel MOSFET can be interchanged with equivalent circuits and components.

A. Boost Controller

The boost controller 201 can comprise of an error amplifier 202, a current sense and artificial ramp circuit 204, a comparator 206, and an optional driver control circuit 208. The error amplifier 202 has a positive input of a reference voltage, $V_{FBREF}$, and a negative input of a reference voltage, $V_{LVS}$. The output of the error amplifier 202 is connected to a switch 209. The voltage at the output of the error amplifier 202 can be denoted, $V_{comp}$.

The output of the error amplifier 202 is connected to an input of a comparator 206 when a control signal, PWM2, is high (i.e. the switch 209 is closed); thus connecting the error amp 202 to the comparator 206 via the closed switch 209. When the switch 209 is closed, the error amplifier's 202 output voltage, $V_{comp}$, can be stabilized by an RC circuit 220.

A second voltage $V_{sum}$ is applied to another input of the comparator 206. The voltage $V_{sum}$ is generated by the current sense and artificial ramp circuit 204. The comparator 206 compares $V_{comp}$ and $V_{sum}$, and generates a square wave, $V_{pwm}$, from this comparison.

The voltage signal, $V_{pwm}$ is applied to a driver control circuit 208. The driver control circuit 208 is used to add current protection and logic control protection, thus it can be an optional component of this circuit. The driver control circuit 208 then passes the $V_{pwm}$ voltage signal to an and-gate 222. The other input of the and-gate 222 is a control signal, PWM3.

The output of the and-gate 222 is connected to the gate of a power MOSFET 224. When both inputs of the and-gate 222, $V_{pwm}$ and PWM3, are at high values (e.g., both values are 1), then the and-gate 222 outputs a high value to the power MOSFET 224; thus turning on the power MOSFET 224. In the on state, the power MOSFET 224 conducts, and resembles a resistor with a small resistance, $R_{sdon}$ (around 10 ohms). This resistance causes a voltage drop across the power MOSFET 224.

The current sense and artificial ramp circuit 204 senses the current over an inductor L, and generates a voltage $V_{sum}$. The inductor, L, is charged by the current.

A node LX having a voltage potential $V_{LX}$ connects to a Schottky diode 228, which in turn connects to the plurality of channels at a node 230 having a voltage $V_{out}$. The node 230 is also connected to a capacitor, $C_{out}$, which in turn is connected to ground.

When the MOSFET 224 is in an off state (i.e. the and-gate outputs a low signal), the MOSFET 224 is an open circuit. Thus, the inductor L discharges to the Schottky diode 228. In this manner, a step-up voltage is achieved by boosting a $V_{in}$ voltage to a higher voltage, $V_{out}$. Boost converting may be necessary since $V_{in}$ is generally between 6 to 24 volts, which is not sufficient to drive the LEDs of the channels at saturation. With ten diodes connected in series on each channel and where each diode may have a voltage drop of around 3 volts, the voltage $V_{out}$ must generally be at least 32 to 36 volts. Also, with more diodes in series, the minimum turn on voltage could possibly be even higher than 36 volts; thus necessitating a greater step-up in voltage from $V_{in}$ to a higher $V_{out}$. Therefore, the boost converter provides the necessary voltage to drive the eight parallel channels of LEDs.

B. Lowest Voltage Selector

All the channels are connected to a lowest voltage selector 210. The lowest voltage selector 210 compares the voltages from each channel to find a lowest voltage $V_{LVS}$ among the eight channels. The $V_{LVS}$ value corresponds to the greatest voltage drop across a channel amongst the eight channels. Generally when the circuit is in a steady state, the $V_{LVS}$ voltage will be regulated to a voltage, $V_{FBREF}$, of around 400 mV. The $V_{LVS}$ value should be minimized to increase the efficiency of the circuit. The lowest voltage selector 210 outputs the $V_{LVS}$ voltage to the negative input of the error amplifier 202.

C. Current Source

A current source 212 is connected to each channel to provide a pulse width modulation signal. There are a total of eight current sources; one current source for each of the eight channels. A control signal PWM1 and a reference voltage $V_{CSREF}$ are applied to each current source 212. The current source 212 uses these inputs to adjust the electric current for its respective channel.

Figure 3:
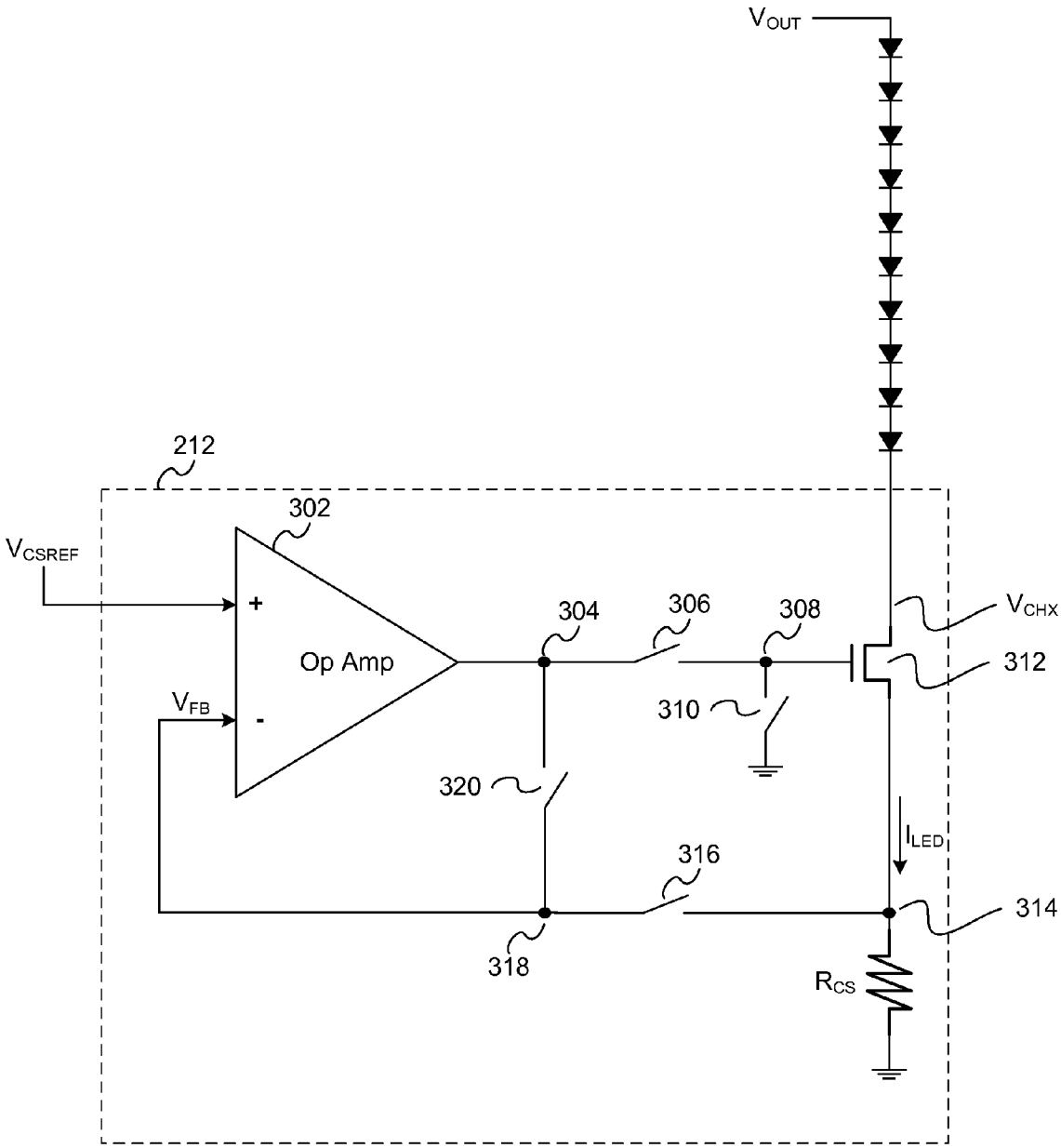
FIG. 3 illustrates a current source circuit with dimming control circuitry.

FIG. 3 illustrates a current source circuit with a dimming control circuitry for a channel of LEDs. The current source circuit 212 includes an operational amplifier 302, wherein the $V_{CSREF}$ voltage is applied to the positive terminal of the operational amplifier 302, and a $V_{FB}$ voltage is applied to the negative terminal of the operational amplifier 302. The operational amplifier outputs to a node 304.

The node 304 is connected to a switch 306. The switch 306 is controlled by the control signal, PWM1. When the PWM1 signal is high, then the switch is closed; thus connecting the node 304 to a node 308. The node 308 is connected to the gate of a MOSFET 312. The node 308 also connects to another switch 310, where that switch connects to ground thus shorting the node when the switch 310 is closed. The inverted signal of PWM1, denoted as PWMB1, controls the switch 310 and controls a switch 320. When PWMB1 is high, the switch 310 and 320 are closed.

The drain terminal of the MOSFET 312 is connected to the end of a channel of diodes, where the voltage at this connection can be denoted, $V_{CHX}$. The source terminal of the MOSFET 312 is connected to a node 314. The node 314 is also connected to a terminal of a resistor $R_{CS}$. The other terminal of $R_{CS}$ is connected to ground.

The node 314 also connects to a switch 316, where the switch 316 is controlled by the control signal PWM1. When PWM1 is high, then the switch 316 is closed and connects the node 314 with a node 318, where the voltage at node 318 is the $V_{FB}$ voltage. The node 318 connects to the switch 320.

Thus the current source 212 drives a current, $I_{LED}$, over a resistor $R_{CS}$ when PWM1 is high (thus closing switch 306 and closing switch 316). When the $V_{CSREF}$ voltage is greater than the $V_{FB}$ voltage, the MOSFET 312 is driven to its on state. The MOSFET then draws current, $I_{LED}$, from the channel.

When the current source circuit is closed, $I_{LED}$ is given by $$I_{LED}=V_{CSREF}/R_{CS} \quad (1)$$

When the current source 212 circuit is in an off state (i.e. PWM1 is in a low state, and PWMB1 is in a high state), the switch 306 is opened, the switch 316 is opened, the switch 320 is closed, and the switch 310 is closed. Since the switch 310 is closed, the base of the MOSFET is grounded and therefore in a low state, preventing any current from passing through the MOSFET from the channel of diodes. Therefore, the LEDs will be in an off state. When the current source is in an on state, then the LEDs are activated. By applying a pulse width modulation to the PWM1 signal, the LEDs' brightness can be adjusted according to the PWM1 signal.

D. Current Reference Generator

Referring back to FIG. 2, the current reference generator 214 generates two reference voltages, the $V_{FBREF}$ and the $V_{CSREF}$. As discussed earlier, the $V_{FBREF}$ voltage is applied to the error amplifier 202 and the $V_{CSREF}$ voltage is applied to each current source 212. The current reference generator 214 connects to one terminal of an external resistor, $R_{SET}$. The other terminal of $R_{SET}$ is connected to ground. A current that flows through the resistor $R_{SET}$ can be denoted $I_{SET}$.

Figure 4:
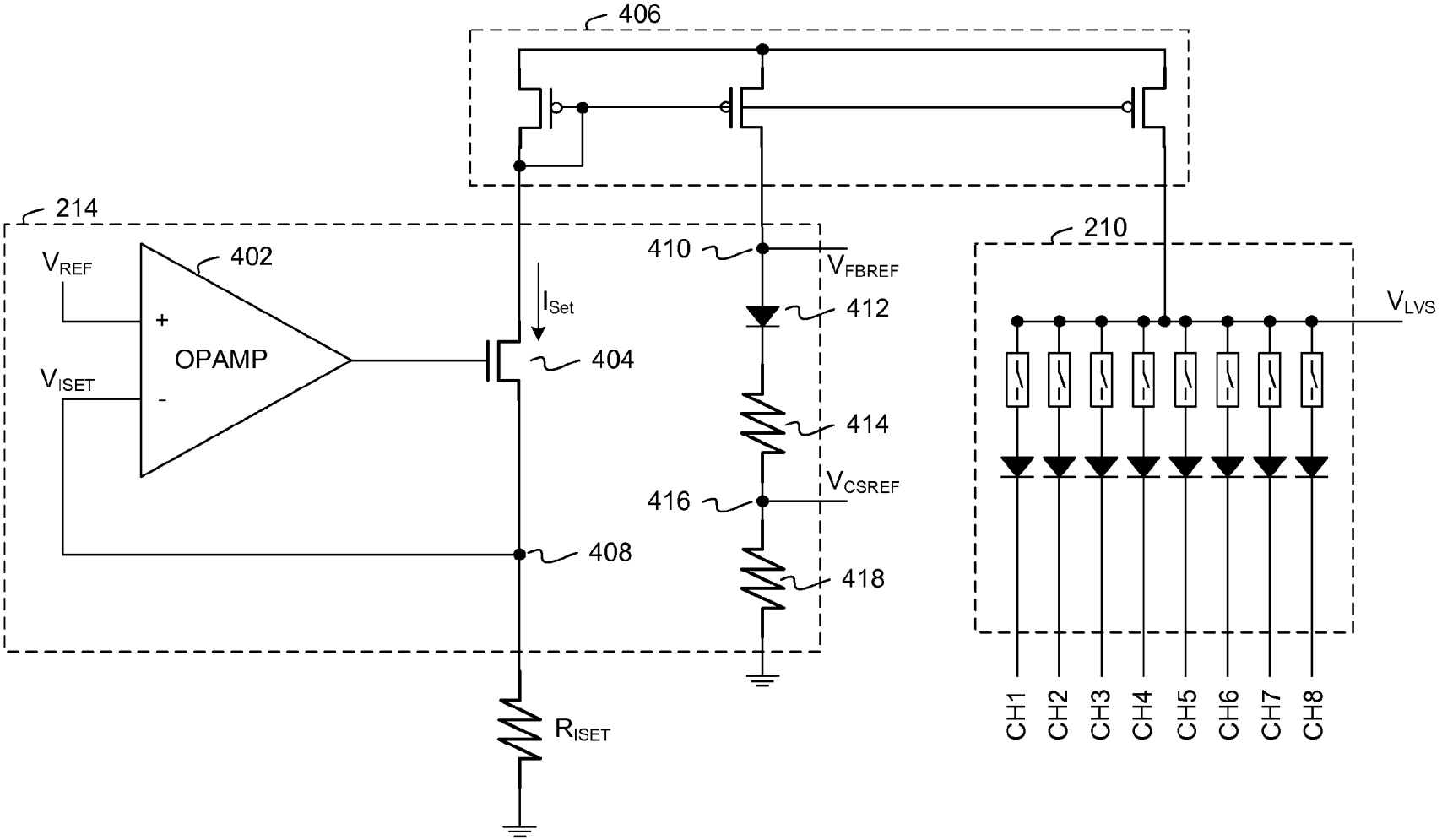
FIG. 4 illustrates a current reference generator circuit and its relationship with other components in a PWM dimming control circuit of this invention.

FIG. 4 illustrates a current reference generator circuit and its relationship with other components in a PWM dimming control circuit of this invention. The current reference generator 214 comprises an operational amplifier 402, where a reference voltage, $V_{REF}$, is applied to the positive input of the operational amplifier 402 and a setting voltage, $V_{ISET}$, is applied to the positive input to the operational amplifier 402.

The operational amplifier 402 output is connected to the gate of a MOSFET 404. The drain of the MOSFET 404 is connected to a current mirror 406. The current mirror 406 has three connection terminals, where current flowing through the first terminal can be denoted $I_{SET}$, the current through the second terminal can be denoted $K*I_{SET}$ (where K is a current mirror gain), and the current through the third terminal can be denoted $K*I_{SET}$. The current $I_{SET}$ is applied at the drain of the MOSFET 404. The source of the MOSFET 404 is connected to a node 408.

The node 408 further connects to one terminal of a resistor, $R_{ISET}$, which can be outside the chip of the dimming controller circuit. The other terminal of the resistor $R_{ISET}$ is connected to ground. With the use of the current mirror 406, an LED current can be adjusted by this external resistor $R_{ISET}$. The node 408 is also connected to the negative input of the operational amplifier 402.

The second terminal of the current mirror 406 is connected to a node 410, where the voltage at the node 410 can be denoted $V_{FBREF}$. The node 410 is connected to a terminal of a diode 412. The other terminal of the diode 412 is connected to a resistor 414 with a resistance of $R_{CSREF}$. The other terminal of the resistor 414 is connected to a node 416, where the voltage at the node 416 can be denoted $V_{CSREF}$. The node 416 is connected a terminal of a resistor 418 with a resistance of $R_{CSREF}$. The other terminal of the resistor 418 is connected to ground.

The third terminal of the current mirror 406 is connected to the lowest voltage selector 210. The lowest voltage selector 210 comprises eight channels of diodes, wherein the lowest voltage potential amongst the 8 channels is selected and outputted to the error amplifier 202 (illustrated in FIG. 2). Each channel can optionally have a switch to open or close that input. For instance, if the LED circuit only has three channels of LEDs, then the lowest voltage selector 210 can close three switches to read the voltage over the active 3 channels, and leave the other 5 switches opened since they are not needed. Alternatively, the lowest voltage selector 210 can have more, less, or the same number of channels of LEDs.

The circuit can be analyzed to find the following equations:

$$V_{FBREF}=2\times V_{CSREF}+V_{diode} \quad (2)$$

$$V_{LVS}=\min\{V_{CHX}\}+V_{diode} \quad (3)$$

where $V_{CHX}=\{V_{CH1}, V_{CH2}, V_{CH3}, V_{CH4}, V_{CH5}, V_{CH6}, V_{CH7}$, and $V_{CH8}\}$ corresponding to the voltage for each channel. When the circuit is in a steady state, the lowest feedback channel voltage equals $2\times V_{CSREF}$.

Furthermore, the current, $I_{LED}$ can be found by Equation (4).

$$I_{LED}=K^*(V_{REF}/R_{ISET})^*(R_{CSREF}/R_{CS}) \quad (4)$$

Therefore, by setting the value of $R_{ISET}$, the current over the LEDs can be adjusted.

E. PWM-IN Control Signal

Figure 5:
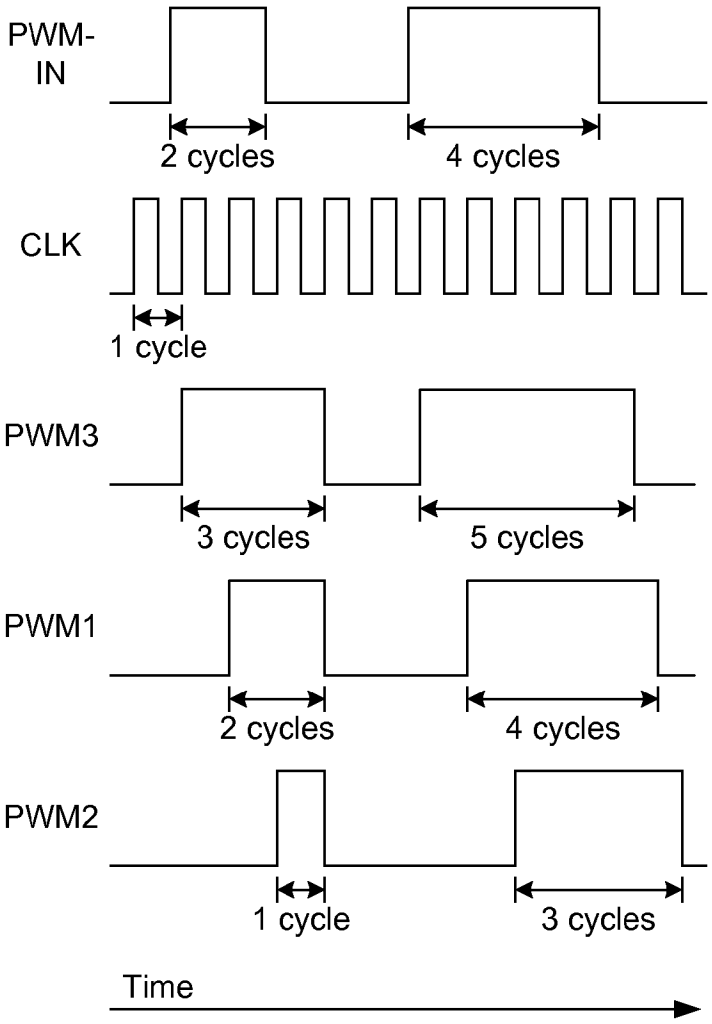
FIG. 5 illustrates a graph of a PWM input signal, and its relationship to a clock signal, a PWM3 signal, a PWM1 signal, and a PWM2 signal.

FIG. 5 illustrates a graph of a PWM-IN control signal, and its relationship to a booster controller clock signal ("CLK"), the control signal PWM1, the control signal PWM2, and the control signal PWM3.

An input signal ("PWM-IN") is applied to the LED dimming control circuit 200 to adjust the duty cycle (i.e., the on state period) of the LEDs for each CLK cycle. Alternatively, PWM-IN can maintain the duty cycle of the LEDs for each CLK cycle. For instance, the width of the pulse of the PWM-IN signal is proportional to duty cycle of the PWM dimming control circuit 200. The wider the pulse of the PWM-IN signal, the wider the duty cycle of the PWM circuit, thus the brighter the LED will appear.

A cycle is determined by a booster controller clock signal. The clock signal can have two states, a high state (e.g. 1) and a low state (e.g. 0), where the clock cycle switches between the high state to low state and vice versa at a constant frequency. When the clock signal goes from low to high, the PWM dimming control circuit 200 samples the PWM-IN signal, and then generates a plurality of control signals (PWM1, PWM2, and PWM3).

If the PWM-IN signal is high when sampled, then the PWM3 signal changes from low to high. The pulse width of the PWM3 signal is kept high for one CLK cycle longer than the PWM-IN; thus, the pulse width of PWM3 signal is one CLK cycle wider than the pulse width of its corresponding sampled PWM-IN signal. For instance, if the sampled PWM-IN signal has a width of two CLK cycles, the corresponding PWM3 signal will have a width of three CLK cycles. After three CLK cycles, the PWM3 signal drops to the low state, until the next high signal of the PWM-IN signal is sampled. The PWM3 signal can have at least one more cycle than the PWM-IN signal to compensate for the output voltage drop and the inductor current of the boost converter.

One CLK cycle after the PWM3 signal goes from low to high, the PWM1 signal changes from low to high states. The PWM1 pulse width is one less clock cycle than the PWM3 signal. For instance, if the pulse width of the PWM3 signal is three cycles, then the pulse width of the corresponding the PWM1 signal can be two clock cycles. The PWM1 clock cycle can also be one clock cycle later than a corresponding PWM3 signal.

The PWM1 signal controls the current source, so it can have the same pulse width as the PWM-IN signal. When the PWM1 signal is high, the current source regulation loops will be closed, thus generating current for the channels. The PWM1 signal can have a one cycle delay from the PWM-IN signal.

A PWM2 cycle can begin after two cycles from when a PWM3 cycle has begun. The pulse width of a PWM2 is also two less than the PWM3.

The PWM2 signal controls the booster switch and driver. The PWM2 signal can have a two cycle delay from the CLK cycle sampling, and can have a pulse width that is one CLK cycle smaller. Boost compensation loop has one less CLK cycle compared to the PWM1 signal because the $V_{LVS}$ voltage may need at least one cycle to settle down.

F. Current Matching and Calibration

Figure 6:
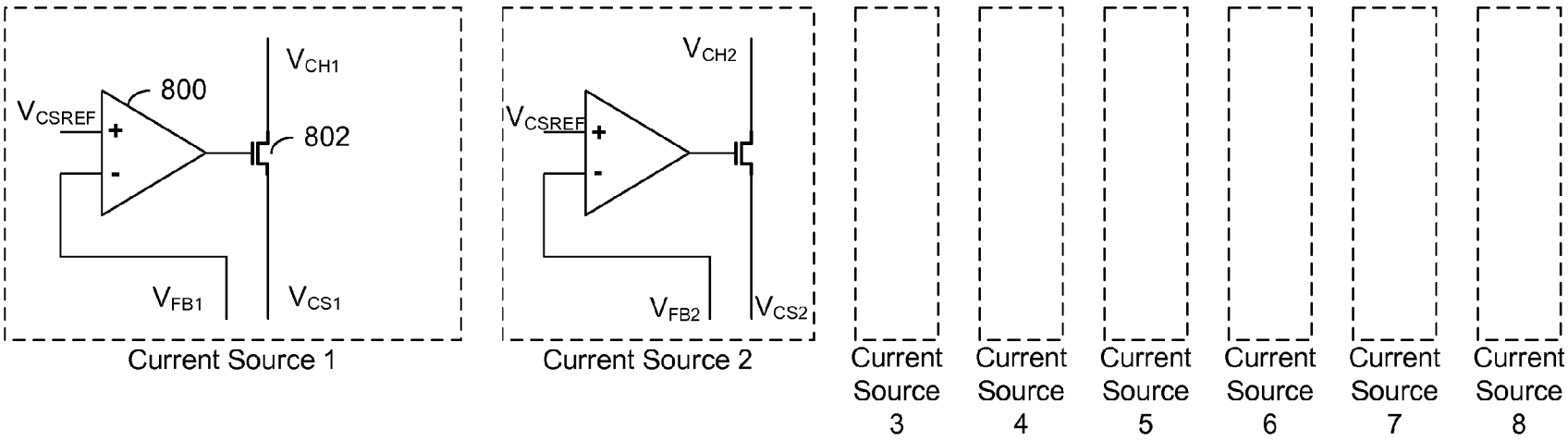
FIG. 6 illustrates an embodiment of the present invention for matching current of a channel.

FIG. 6 illustrates an embodiment of the present invention for matching electric currents of various channels. This invention can be used for a plurality of current sources, where each current source can drive a respective LED channel. Here, eight current sources are illustrated. Each current source drives one channel. In a current source 1, a channel $V_{CH1}$ is connected to an operational amplifier 800 via a MOSFET 802. A voltage for the negative input of the operational amplifier 800 can be denoted $V_{FB1}$. A voltage at the source drain of the MOSFET 802 can be denoted $V_{CS1}$. This nomenclature can be extended to a current source 2 (e.g. $V_{FB2}$ and $V_{CS2}$), and so forth for the other current sources since schematically all the current sources are substantially similar.

This current source is similar to the current source previously described in FIG. 3, except that in this figure to aid in the understating of the invention, the circuit is in an on state (i.e. the switch 306 and the switch 316 are closed). An important feature of the present invention is in how the $R_{CS}$ resistors and $R_{CSREF}$ are physically laid out and connected with one another.

Figure 7:
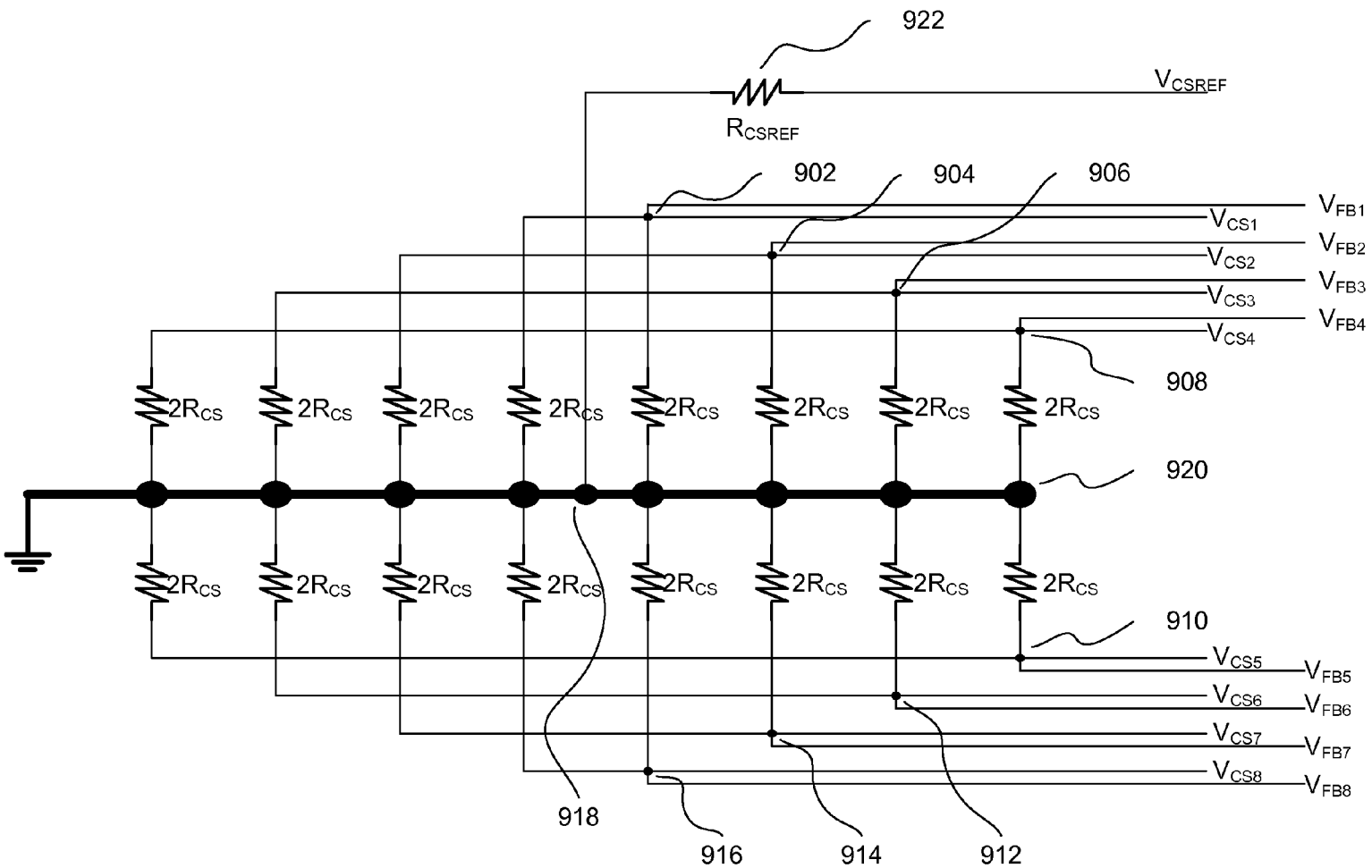
FIG. 7 illustrates a resistor layout of the present invention for use by the plurality of current sources.

FIG. 7 illustrates a resistor layout of the present invention for use by the plurality of current sources. The voltage $V_{CSREF}$ is connected to one terminal of a resistor 922. The other terminal of the resistor 922 is connected to ground 920. The negative input of the operational amplifier for a first current source (not shown), $V_{FB1}$, is connected to the MOSFET of the first current source (not shown), $V_{CS1}$, via a node 902. The node 902 connects to two resistors in parallel, where the resistance of each resistor is $2^*R_{CS}$. These two resistors are then connected to the ground 920, where the two resistors are the same distance away from the wire connecting the resistor 922 and the ground 920.

The negative input of the operational amplifier for a second current source (not shown), $V_{FB2}$, is connected to the MOSFET of the second current source (not shown), $V_{CS2}$, via a node 904. The node 904 connects to two resistors in parallel, where the resistance of each resistor is $2^*R_{CS}$. These two resistors are then connected to the ground 920, where each of the two resistors is equidistance from the wire connecting the resistor 922 and the ground 920.

The negative input of the operational amplifier for a third current source (not shown), $V_{FB3}$, is connected to the MOSFET of the third current source (not shown), $V_{CS3}$, via a node 906. The node 906 connects to two resistors in parallel, where the resistance of each resistor is 2*RCS. These two resistors are then connected to the ground 920, where each of the two resistors is equidistance from the wire connecting the resistor 922 and the ground 920.

The negative input of the operational amplifier for a fourth current source (not shown), $V_{FB4}$, is connected to the MOSFET of the fourth current source (not shown), $V_{CS4}$, via a node 908. The node 908 connects to two resistors in parallel, where the resistance of each resistor is $2*R_{CS}$. These two resistors are then connected to the ground 920, where each of the two resistors is equidistance from the wire connecting the resistor 922 and the ground 920.

The negative input of the operational amplifier for a fifth current source (not shown), $V_{FB5}$, is connected to the MOSFET of the fifth current source (not shown), $V_{CS5}$, via a node 910. The node 910 connects to two resistors in parallel, where the resistance of each resistor is $2*R_{CS}$. These two resistors are then connected to the ground 920, where each of the two resistors is equidistance from the wire connecting the resistor 922 and the ground 920.

The negative input of the operational amplifier for a sixth current source (not shown), $V_{FB6}$, is connected to the MOSFET of the sixth current source (not shown), $V_{CS6}$, via a node 912. The node 912 connects to two resistors in parallel, where the resistance of each resistor is $2*R_{CS}$. These two resistors are then connected to the ground 920, where each of the two resistors is equidistance from the wire connecting the resistor 922 and the ground 920.

The negative input of the operational amplifier for a seventh current source (not shown), $V_{FB7}$, is connected to the MOSFET of the seventh current source (not shown), $V_{CS7}$, via a node 914. The node 914 connects to two resistors in parallel, where the resistance of each resistor is $2*R_{CS}$. These two resistors are then connected to the ground 920, where each of the two resistors is equidistance from the wire connecting the resistor 922 and the ground 920.

The negative input of the operational amplifier for an eighth current source (not shown), $V_{FB8}$, is connected to the MOSFET of the first current source (not shown), $V_{CS8}$, via a node 916. The node 916 connects to two resistors in parallel, where the resistance of each resistor is $2*R_{CS}$. These two resistors are then connected to the ground 920, where each of the two resistors is equidistance from the wire connecting the resistor 922 and the ground 920.

By connecting each of the two resistors for the current sources equidistance from the wire connecting the resistor 922 and the ground 920, the metal connection resistance between resistors to the respective MOSFET of each current source can be ignored. Therefore, the current matching precision between the channels can be maximized.

Figure 8A:
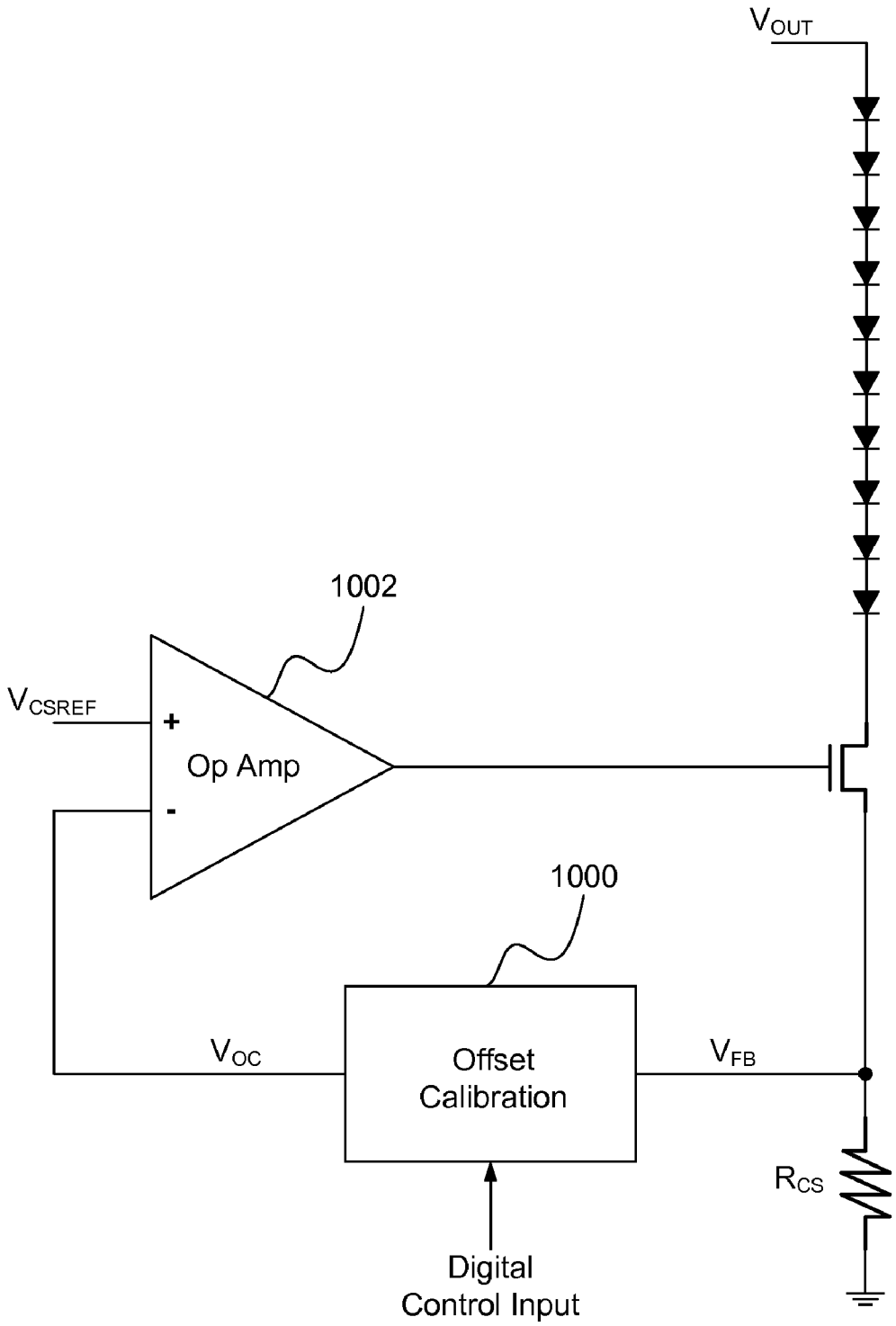
FIG. 8*a* illustrates an offset calibration circuit block connected between an operational amplifier and a RCS resistor of a current source.

Also, an offset calibration circuit can be used to improve current matching between the channels. FIG. 8*a* illustrates an offset calibration circuit block connected between an operational amplifier and a $R_{CS}$ resistor of a current source. An offset calibration circuit 1000 can be controlled by a 3 bit digital control input, SEL[2:0]. The voltage $V_{FB}$ is applied to the offset calibration circuit 1000. The offset calibration circuit 1000 can offset the voltage $V_{FB}$ by an offset $V_{OFFSET}$ to counteract inaccuracies caused by the operational amplifier 1002 in the current source.

Figure 8B:
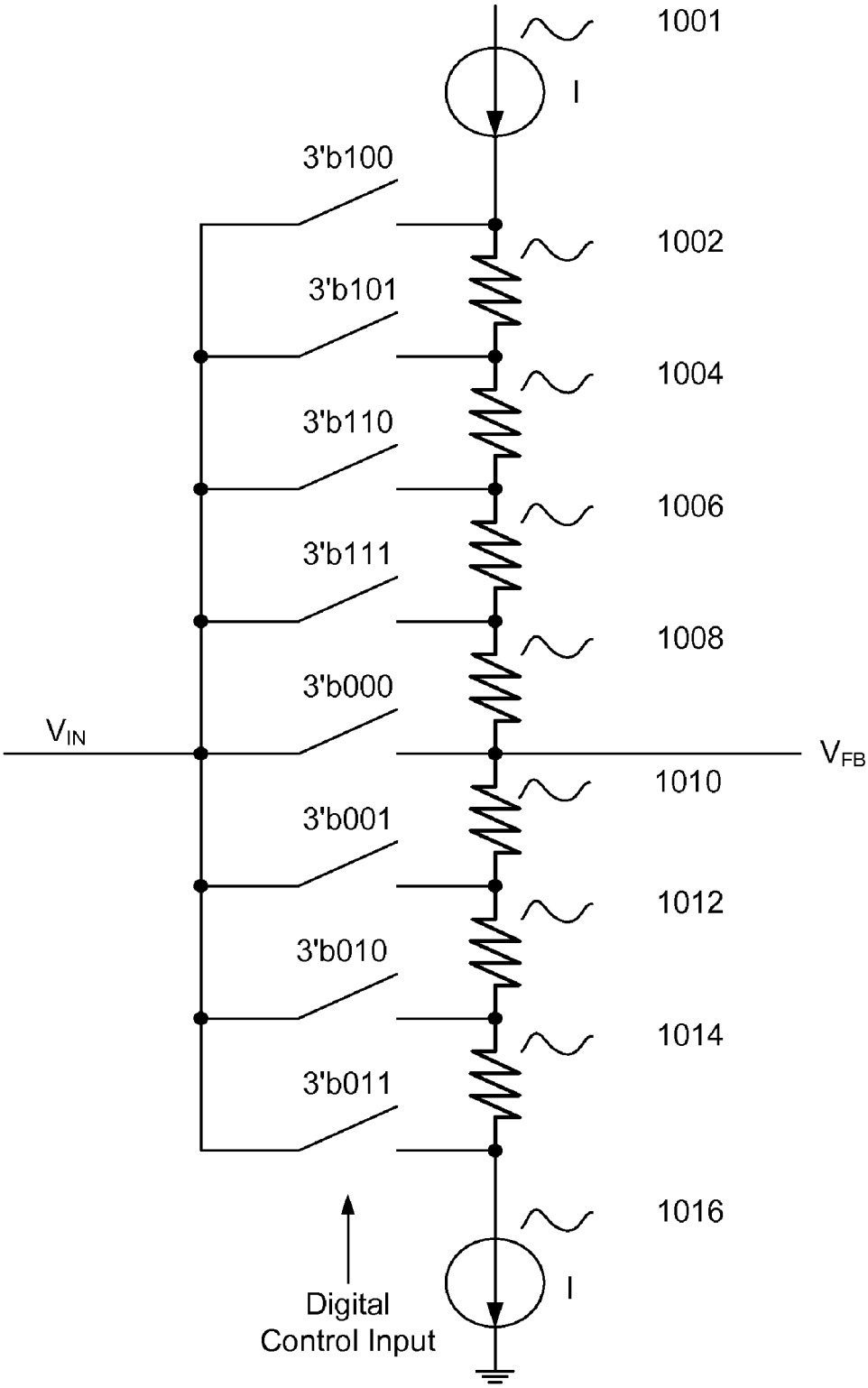
FIG. 8*b* illustrates the offset calibration circuit block. A current source 1001 is connected to one terminal of a resistor 1002.

FIG. 8*b* illustrates the offset calibration circuit. A current source 1001 is connected to one terminal of a resistor 1002. This terminal of the resistor 1002 can be connected to a voltage $V_{OC}$ via a switch 3'b100. Another terminal of the resistor 1002 is connected to one terminal of a resistor 1004. This terminal of the resistor 1004 can be connected to $V_{OC}$ via a switch 3'b101. Another terminal of the resistor 1004 is connected to one terminal of a resistor 1006. This terminal of the resistor 1006 can be connected to $V_{OC}$ via a switch 3'b110. Another terminal of the resistor 1006 is connected to one terminal of a resistor 1008. This terminal of the resistor 1008 can be connected to $V_{OC}$ via a switch 3'b111. Another terminal of the resistor 1008 is connected to one terminal of a resistor 1010. This terminal of the resistor 1010 is connected to $V_{FB}$, and can be connected to $V_{OC}$ via a switch 3'b000. Another terminal of the resistor 1010 is connected to one terminal of a resistor 1012. This terminal of the resistor 1012 can be connected to $V_{OC}$ via a switch 3'b001. Another terminal of the resistor 1012 is connected to one terminal of a resistor 1014. This terminal of the resistor 1014 can be connected to $V_{OC}$ via a switch 3'b010. Another terminal of the resistor 1014 can be connected to $V_{OC}$ via a switch 3'b011. This terminal can also be connected to another current source 1016, with current I flowing away from this terminal.

The switches 3'b100, 3'b101, 3'b110, 3'b111, 3'b000, 3'b001, 3'b010, and 3'b011 can be controlled by the 3 bit digital control input, SEL[2:0]. The digital control input can be used to indicate which one of the switches to close, while the other switches are opened. Thus, the current I through its respective channel can be adjusted accordingly. The resistance of each of the resistors 1002, 1004, 1006, 1008, 1010, 1012, and 1014 can be R. The number of switches and resistances can vary depending on the accuracy needed to be achieved by the offset calibration circuit The current source and the one or more resistors placed in series can be used to adjust the offset voltage, and subsequently adjust the respective current for that channel. The default setting where offset calibration is not introduced is when the switch 3'b000 is closed. Without offset calibration (i.e. SEL[2:0]=3'b000), the LED current can be given by $$I = \frac{V_{FB}}{R} = \frac{V_{IN}}{R} = \frac{V_{CSREF} + V_{OFFSET}}{R} \tag{5}$$

As evidenced from Equation (5), the LED current changes from the ideal value of $V_{CSREF}/R$ by an error offset of $V_{OFFSET}/R$. This error offset can be due to the operational amplifier of the current source. To adjust the $V_{FB}$ to cancel this error offset, the digital control input can be used to close one of the switches to adjust the resistance, and consequently adjust the voltage of $V_{FB}$.

A step offset voltage of I*R, 2I*R, 3I*R, . . . , NI*R, where N is an integer number, can be applied to cancel this error offset. A resistance, R, can be selected as needed to provide for different voltage steps. Here, to compensate the error offset caused by the operational amplifier, $V_{OFFSET}/R$, one of the switches in the offset calibration circuit is closed, such that $N*I*R+V_{OFFSET}$ is equal to zero (or approximately close to zero). Therefore, the LED current can be found by $$I = \frac{V_{FB}}{R} = \frac{V_{IN} + N*I*R}{R} = \frac{V_{CSREF} + V_{OFFSET} + N*I*R}{R} \tag{6}$$

G. Current Sense and Artificial Ramp

Figure 9:
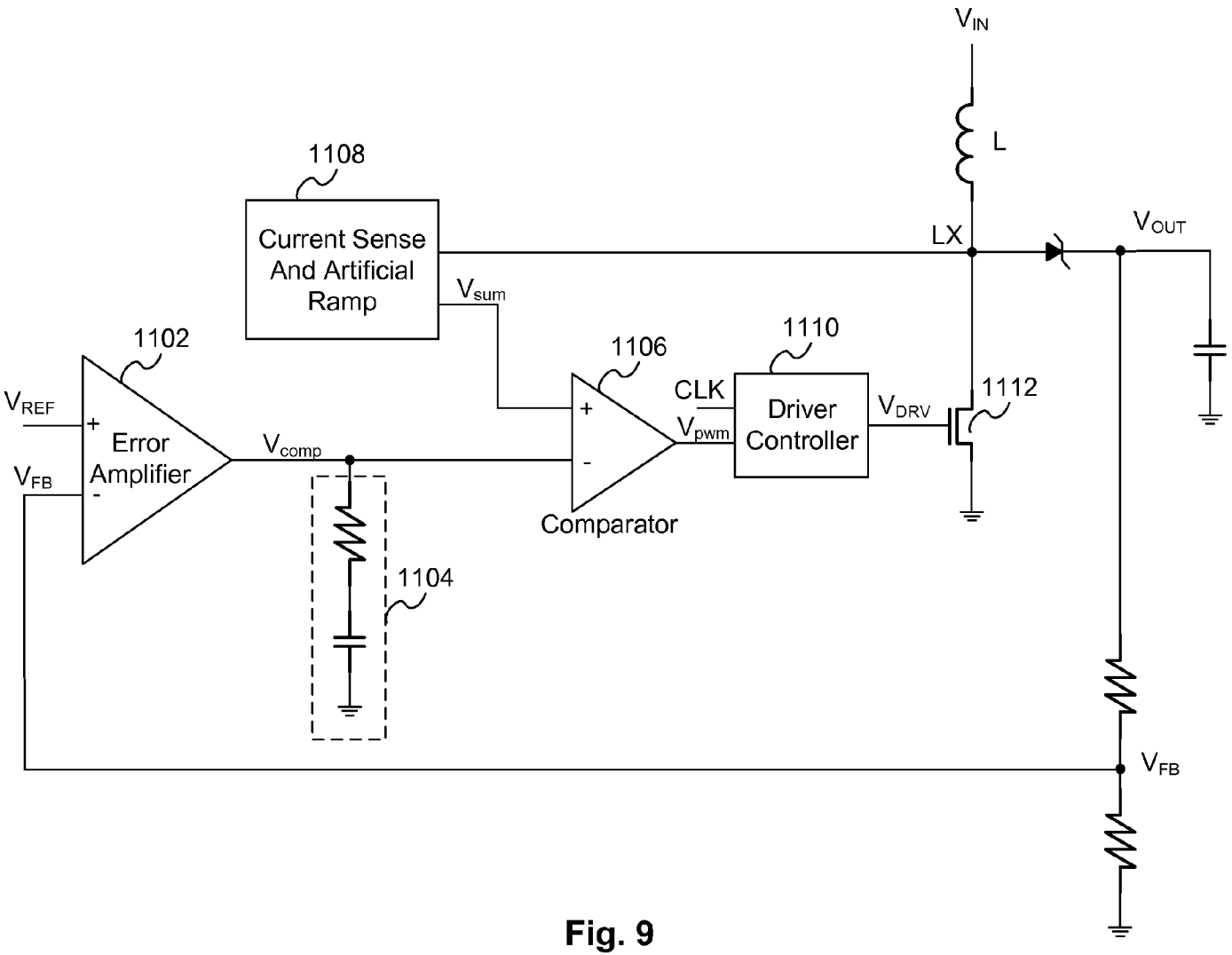
FIG. 9 illustrates a circuit diagram for a boost converter with a boost controller circuit.

FIG. 9 illustrates a circuit diagram for a boost converter with a boost controller circuit. The boost controller circuit can comprise an error amplifier 1102, a comparator 1106, a driver controller 1110, and a current sense and artificial ramp circuit 1108. The current sense and artificial ramp circuit 1108 (which can also be referred to as a current control circuit) can be integrated and/or used in conjunction with a number of components where current sensing may be necessary, e.g. in a boost controller circuit (as exemplified here), a buck controller circuit, or other power converting circuits that may need current sensing.

A reference voltage $V_{REF}$ is applied to the positive terminal of the error amplifier 1102. A reference voltage $V_{FB}$ is applied to the negative terminal of the error amplifier 1102. The error amplifier 1102 outputs a voltage signal $V_{comp}$. The voltage signal $V_{comp}$ is further stabilized by an RC circuit 1104. The stabilized $V_{comp}$ signal is then applied to the negative terminal of a comparator 1106. The positive input of the comparator 1106 is a voltage signal, $V_{sum}$, where that voltage signal is generated by the current sense and artificial ramp circuit 1108. The output of the comparator 1106 is a voltage signal, $V_{PWM}$. The $V_{PWM}$ signal is applied to the driver controller 1110. A clock ("CLK") signal of fixed frequency is also applied to the driver controller 1110. The driver controller 1110 generates a $V_{DRV}$ signal as a function of the CLK signal and of the $V_{PWM}$ signal.

The $V_{DRV}$ signal is used to drive a MOSFET 1112. The current sense circuit 1108 senses the current at the node LX of the boost converter and uses that information to generate the $V_{sum}$ signal to stabilize the voltage Vout of the boost converter. The $V_{FB}$ voltage is generated from $V_{out}$ of the boost converter.

Figure 10:
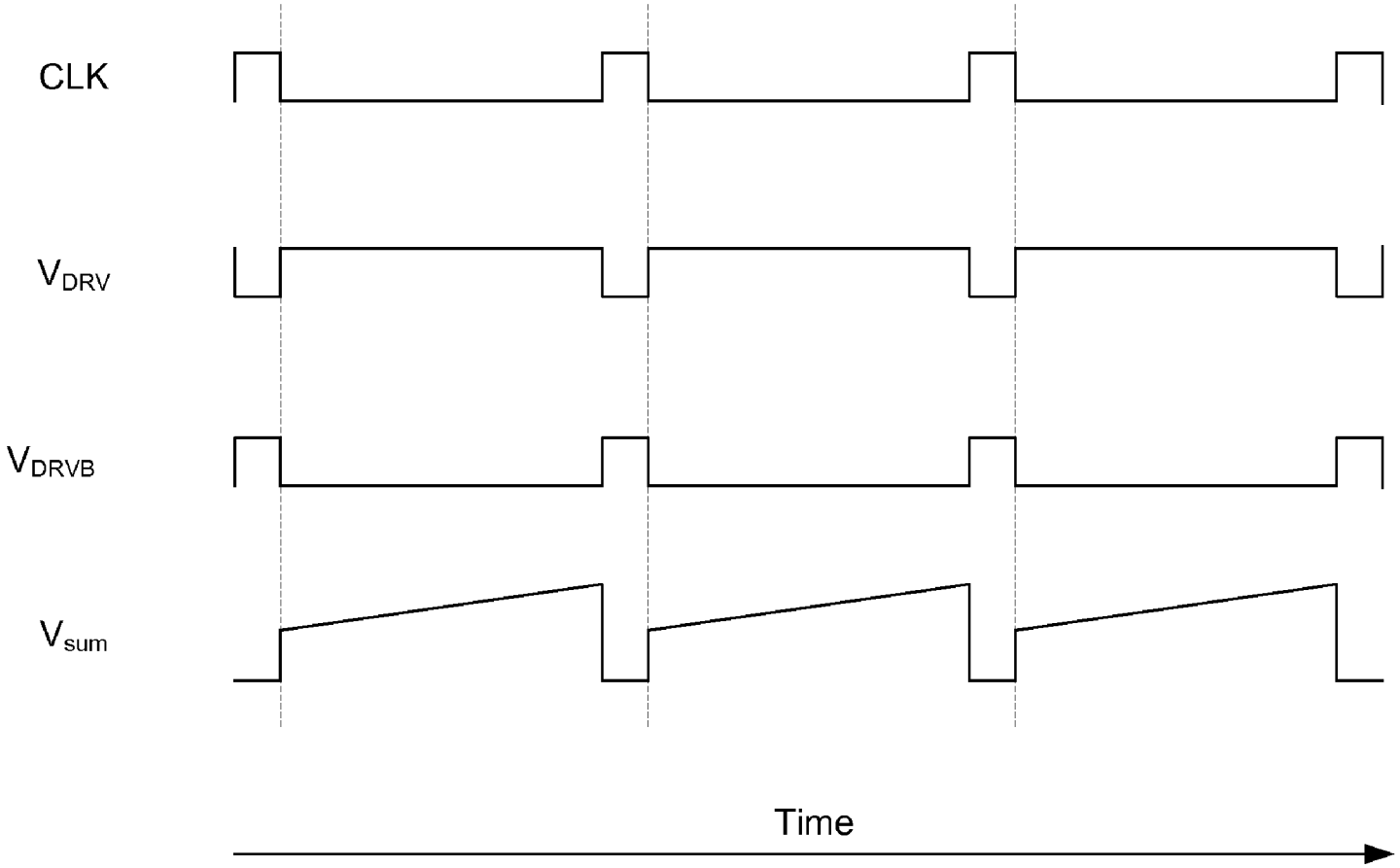
FIG. 10 illustrates the timing relationship between the various signals used by the boost controller circuit and the boost converter circuit.

FIG. 10 illustrates the timing relationship between the various signals used by the boost controller circuit and the boost converter circuit. The CLK signal with a short duty cycle of fixed frequency can be used to generate other control signals. When the CLK signal drops from a high voltage to a low voltage (i.e. a negative edge of CLK), $V_{DRV}$ is set to a high voltage. When the CLK signal goes from a low voltage to a high voltage (i.e. a positive edge of CLK) or the $V_{pwm}$ has a positive edge, then the $V_{DRV}$ voltage is set to a low voltage. The voltage $V_{DRVB}$ is the inverted signal of the $V_{DRV}$ signal. The $V_{DRVB}$ signal can reset the voltage of $V_{sum}$ to a voltage offset.

Figure 11A:
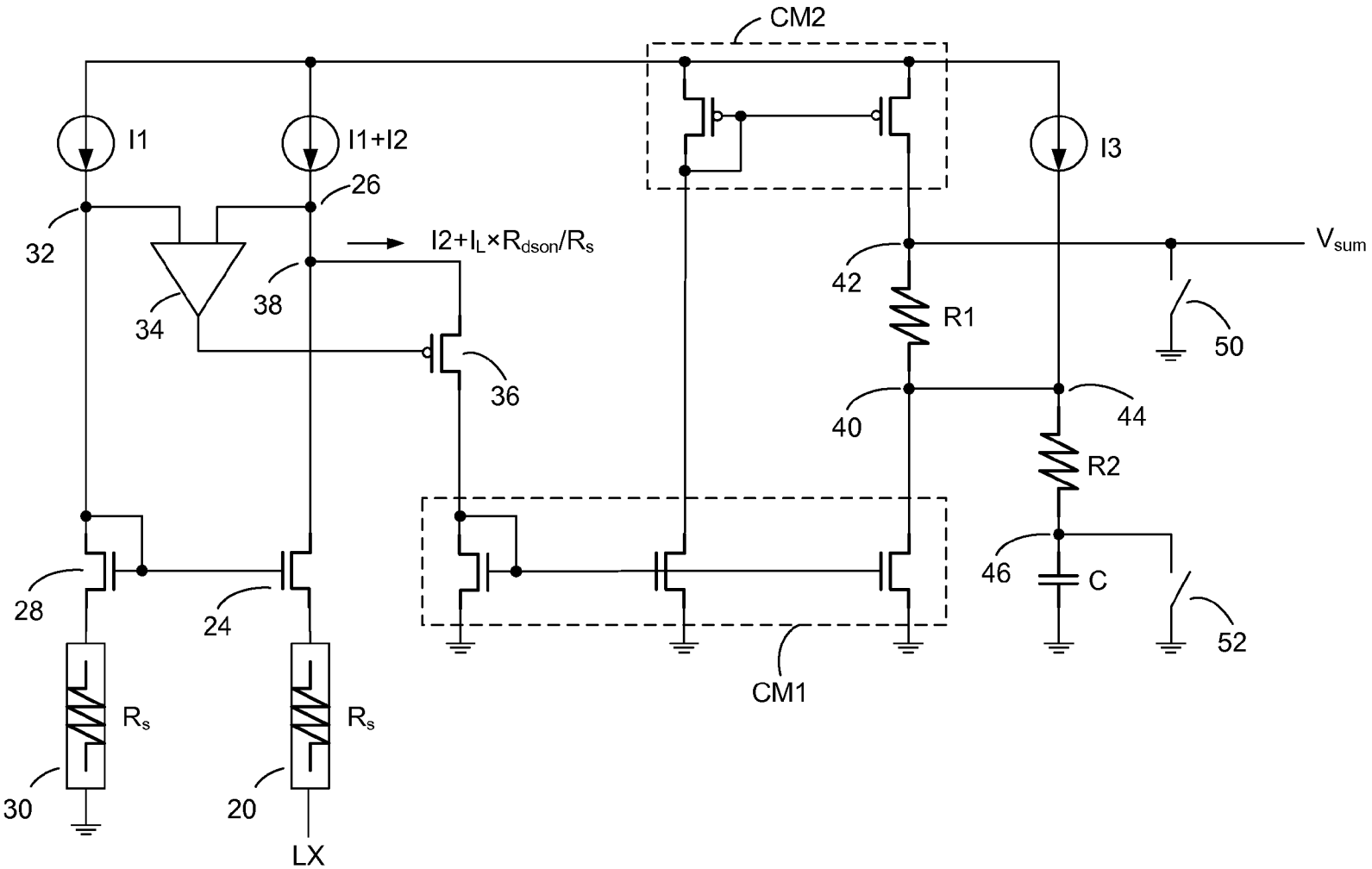
FIGS. 11*a*-11*b* illustrate a current sense and artificial ramp circuit for current sensing in a boost converter.
Figure 11B:
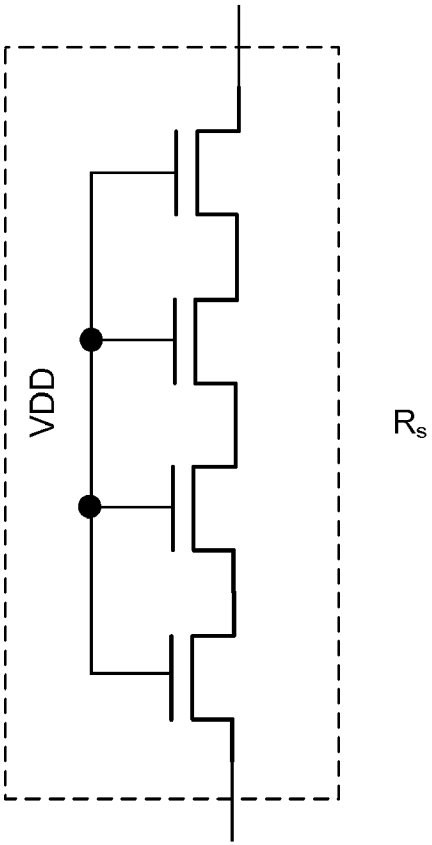

FIG. 11*a* illustrates a current sense and artificial ramp circuit for current control of a boost converter. The current sense and artificial ramp circuit can sense a current at a node LX of the boost converter. The node LX is connected to one end of a terminal of a resistor 20 with a resistance $R_S$, where that resistor 20 can be implemented by a plurality of MOSFETs connected in series with the gates of each MOSFET connected to a node 22 having a voltage potential of VDD, where a drain of one MOSFET is connected to a source of another MOSFET (as illustrated in FIG. 11*b*). The voltage VDD can also be the voltage potential applied to the gate of MOSFET 1112 (see FIG. 9) for turning on the MOSFET 1112, where the MOSFET 1112 has an effective resistance of $R_{dson}$. The resistance $R_s$ can use similar power MOSFETs to compensate for variations in resistance of $R_{dson}$, where those variations can be due to various process points and temperatures. Thus, the value of $R_{dson}/R_s$ can be a constant vector regardless of the temperature of the MOSEFTS or process variations between the MOSFETS.

The other end of the resistor 20 is connected the source input of a MOSFET 24. The drain of MOSFET 24 is connected to a node 38.

The gate of the MOSFET 24 is connected to the gate of another MOSFET 28. The drain of the MOSFET 28 and the gate of the MOSFET 28 are also connected. The source of the MOSFET 28 is connected to one terminal of a resistor 30, where the resistance of resistor 30 is $R_s$ and can be implemented by a plurality of MOSFETs connected in series with the gates of each MOSFET connected to a node, VDD, 22 (as illustrated in FIG. 11*b*). The other terminal of the resistor 30 is connected to ground.

The drain of the MOSFET 28 is connected to a node 32. The node 32 and a node 26 are connected to the inputs of an operational amplifier 34. The output of the operational amplifier is connected to the gate of a p-channel MOSFET 36. A current source with a current of I1 flows through the node 32. A current source of I1+I2 flows through the node 26. The source of the MOSFET 36 is connected to the node 26 via node 38. The drain of the MOSFET 36 is connected to a first connection terminal of a current mirror CM1. A second connection terminal of the CM1 is connected to another current mirror CM2 via a first connection terminal of the CM2. A third connection terminal of the CM1 is connected to a node 40. The node 40 is further connected to a terminal of a resistor R1. The other terminal of resistor R1 is connected to a node 42. The node 42 is connected to the second connection terminal of the CM2. The voltage at the node 42 can be denoted $V_{sum}$. The node 42 can be connected to ground via a switch 50, where that switch 50 is driven by a signal $V_{DRVB}$.

The node 40 is connected to a node 44, wherein a current source with a current I3 flows through the node 44. The node 44 connects to one terminal of a resistor R2. The resistor R2 is then connected to a node 46. The node 46 can be connected to ground via a switch 52, where that switch 52 is driven by the signal $V_{DRVB}$. The node 46 is also connected to one terminal of a capacitor C. The other terminal of the capacitor C is connected to ground.

From the circuit analysis, the current flowing from the node 38 to the source of the MOSFET 36 is equal to $I2+I_L*R_{dson}/R_S$. Furthermore, $V_{sum}$ can be given by $$V_{sum} = (I_2 \times R_1 + I_3 \times R_2) + \left(I_L \times \frac{R_{dson}}{R_S} \times R_1\right) + \frac{1}{C}\int_t I_3\, dt \tag{7}$$

where the first term of $V_{sum}$ can be referred to as a fixed voltage, the second term can be referred to as a current sense voltage, and the third term can be referred to as an artificial ramp.

Figure 12:
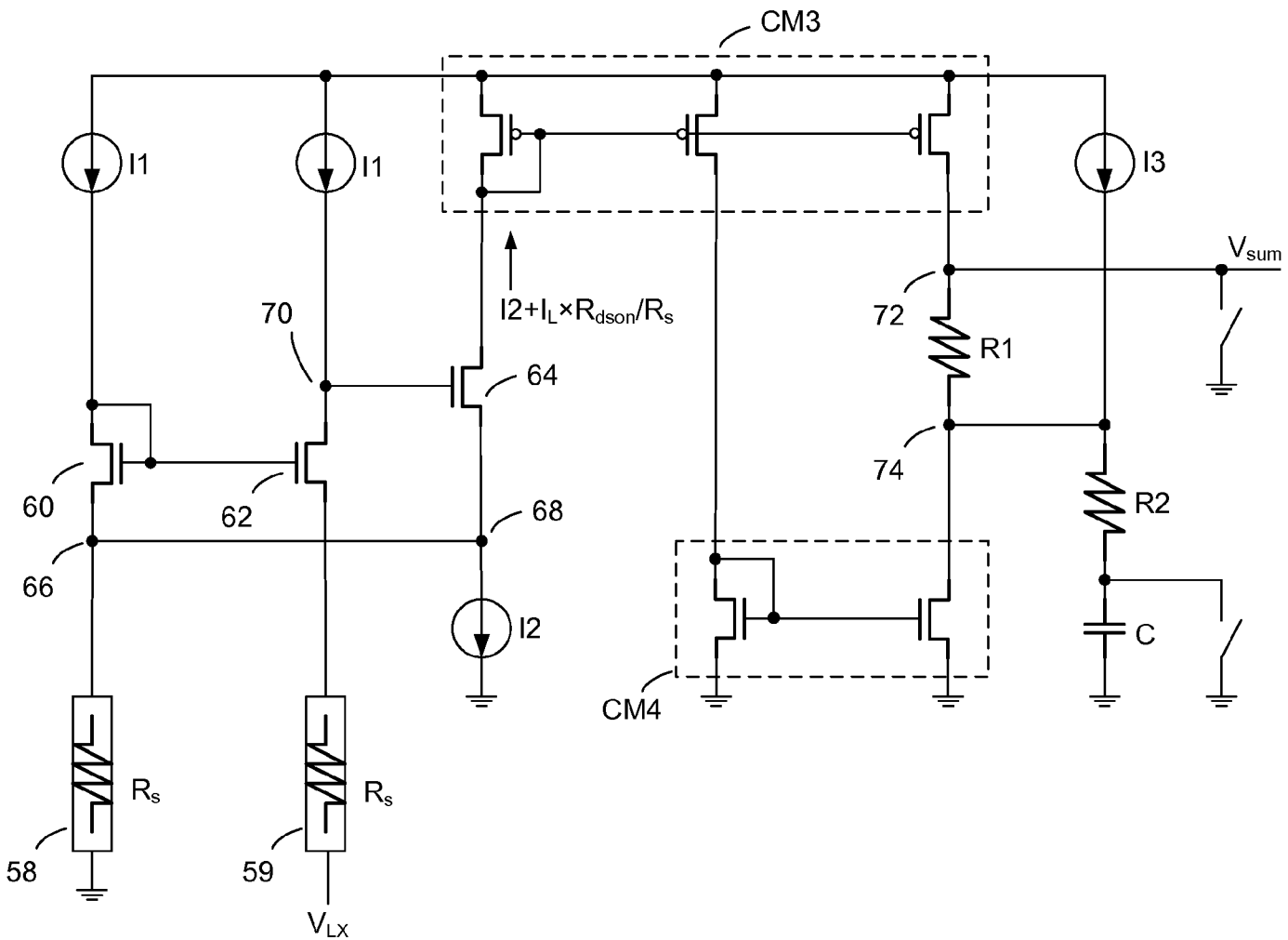
FIG. 12 illustrates another embodiment of the present invention for a current sense and artificial ramp circuit.

FIG. 12 illustrates another embodiment of the present invention for a current sense and artificial ramp circuit. This current sense and artificial ramp circuit is similar to the one illustrated in FIG. 11*a*, however, with a few key differences. One of the differences is that an operational amplifier (as illustrated in FIG. 11*a*) is not present in this current sense and artificial ramp circuit. As such, the current sources, the current mirrors, and some connections have been altered. The advantage of this implementation is that response time is faster and a physical area for the circuit is saved since an operational amplifier is not used.

The drain of a MOSFET 60 is connected to a current source, where that current source drives a current of I1 to the drain of MOSFET 60. The source of the MOSFET 60 is connected to a node 66. The node 66 is connected to a resistor 58 having a resistance of Rs. The node 66 is connected to a node 68. The gate of MOSFET 60 is connected to its drain.

The gate of the MOSFET 60 is also connected to the gate of a MOSFET 62. The source of the MOSFET 62 is connected to a resistor 59 having a resistance of RS, which in turn connects to the boost converter at the node LX, as in the previous embodiment. The drain of the MOSFET 62 is connected to a node 70. The node 70 connects to a current source, which drives a current I1 to node 70. The node 70 further connects to the gate of a MOSFET 64. The source of the MOSFET 64 connects to the node 68. The node 68 further connects to a current source which drives a current I2. The drain of the MOSFET 64 connects to a first connection terminal of a current mirror CM3. The current flow to this first connection terminal of current mirror CM3 can be characterized as $$I2+I_L*(R_{dson}/R_S) \tag{8}$$

A second connection terminal of the CM3 can be connected to a first connection terminal of a second current mirror CM4. A third connection terminal of a CM3 can be connected to a node 72, where the voltage at the node 72 can be denoted $V_{sum}$. The node 72 is further connected to a terminal of a resistor R1. The other terminal of the resistor R1 can be connected to a second connection terminal of the CM4 via a node 74. The remaining components of the circuit, e.g., R1, R2, C, and I3, are connected in the same manner as the previous embodiment illustrated in FIGS. 11*a*-11*b*. *Furthermore, the voltage* $V_{sum}$ can be given by Equation (5). In addition, the CLK signal, the $V_{DRV}$, the $V_{DRVB}$, and the $V_{sum}$ behave in a similar manner to the previous embodiment of the present invention illustrated in FIGS. 11*a*-11*b*.

Figure 13:
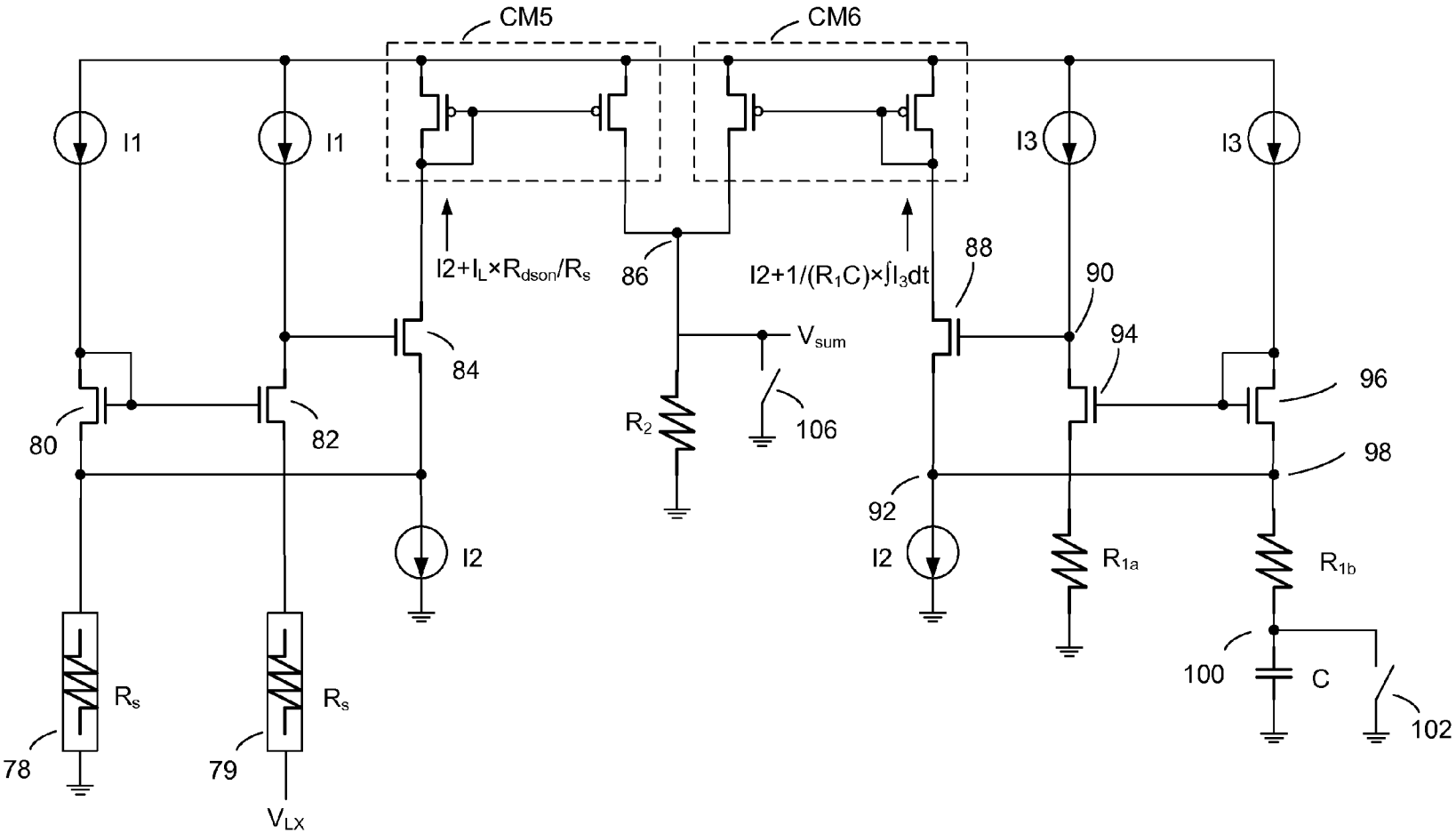
FIG. 13 illustrates yet another embodiment of the present invention for current sensing and artificial ramp circuit.

FIG. 13 illustrates yet another embodiment of the present invention for current sensing and artificial ramp circuit. In this embodiment, two resistors 78 and 79 each with a resistance of Rs, a MOSFET 80, a MOSFET 82, a MOSFET 84, two current sources (each with a current I1), and a third current source with a current I2 are connected in the same manner as illustrated in FIG. 12 and described above. Thus, the resulting current from the source of MOSFET 84 is stated in Equation (8). This current is driven to a first connection with current mirror CM5. A second connection to CM5 is connected to a node 86. The node 86 is further connected to a first connection of a second current mirror CM6. A second connection of the CM6 is connected to the drain of a MOSFET 88. The gate of the MOSFET 88 is connected to a node 90. The source of MOSFET 88 is connected to a node 92. The node 92 is connected to a current source with a current of I2. The node 92 is connected to another node 98.

The node 90 is connected with a current source which drives a current of I3 to the node 90. The node 90 is also connected to the drain terminal of a MOSFET 94. The gate terminal of a MOSFET 94 is connected to the gate terminal of another MOSFET 96. The source terminal of the MOSFET 94 is connected to one terminal of a resistor R1*a*, where the resistor 1*a* having a resistance of R1. The other terminal of R1*a* is connected to ground.

The drain terminal of the MOSFET 96 is connected to its gate. The source terminal of the MOSFET 96 is connected to the node 98. The node 98 is further connected to one terminal of a resistor R1*b*, where the resistor 1*b* having a resistance of R1. The other terminal of the resistor R1*b* is connected to a node 100. The node 100 is connected to one terminal of a capacitor C, wherein the other terminal of C is connected to ground. The node 100 is connected to ground via a switch 102. The switch 102 is driven by the voltage $V_{DRVB}$.

The node 86 is connected to another node 104, where the voltage potential at node 104 is denoted $V_{sum}$. The node 104 is connected to ground via a switch 106. The switch 106 is driven by the $V_{DRVB}$ signal. When the $V_{DRVB}$ signal is high, the switch 106 is closed. When the $V_{DRVB}$ signal is low, the switch 106 is open.

The node 86 is further connected to one terminal of a resistor R2. The other terminal of resistor R2 is connected to ground.

Analyzing the current flowing out of the source terminal of the MOSFET 88, it can be found that this current is given by $$I2+1/(R_1C)\times\int I_3dt \tag{9}$$

Using Equation (8) and Equation (9), $V_{sum}$ is found by $$V_{sum} = (2\times I_2\times R_2) + \left(I_L\times\frac{R_{dson}}{R_S}\times R2\right) + \frac{R_2}{R_1}\times\frac{1}{C}\int_t I_3\,dt \tag{10}$$

where the first term of $V_{sum}$ can be referred to as a fixed voltage, the second term can be referred to as a current sense voltage, and the third term can be referred to as the artificial ramp.

Although, the previous three embodiments of a current sense and artificial ramp are used for a boost converter, it can be appreciated by a person skilled in this field that, these embodiments and these methodologies can be applied to boost converters, buck converters, DC2DC converters, and other circuits where current sense may be useful.

Figure 14:
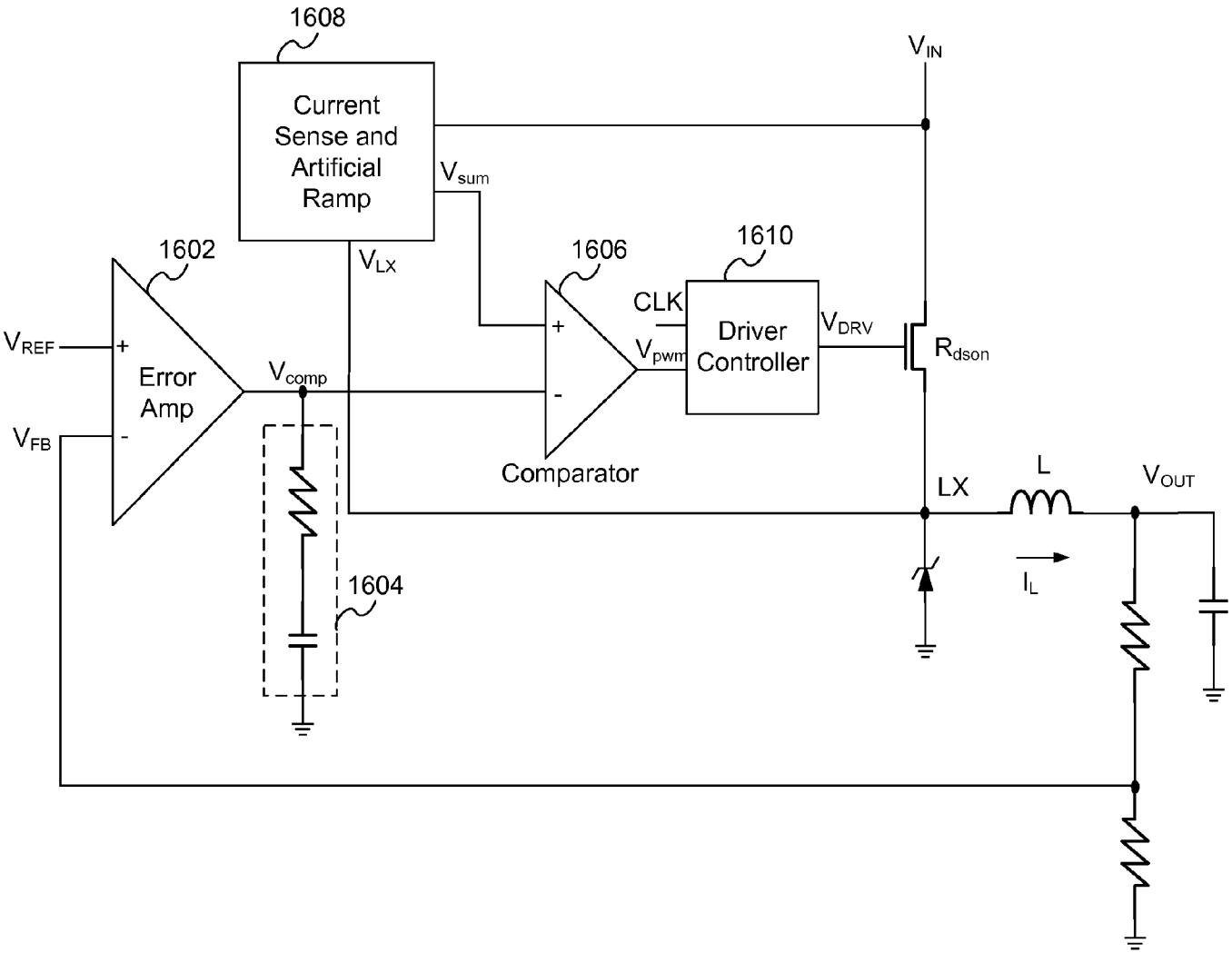
FIG. 14 illustrates another embodiment of the present invention for current sensing for use by a buck converter.

For instance, an embodiment of the present invention can be adapted and applied to a buck converter. FIG. 14 illustrates another embodiment of the present invention for a current control circuit for use by a buck converter. A reference voltage, $V_{REF}$, is applied to the positive input of an error amplifier 1602. A reference voltage, $V_{FB}$, is applied to the negative input of the error amplifier 1602. The error amplifier 1602 outputs a voltage signal, $V_{comp}$. The voltage signal $V_{comp}$ is further stabilized by an RC circuit 1604, and then applied to the negative input of a comparator 1606. The positive input of the comparator 1606 is connected to a voltage signal $V_{sum}$, where the voltage signal $V_{sum}$ is generated by the current sense and artificial ramp block 1608. The output of the comparator 1606 is a voltage signal $V_{PWM}$. The voltage $V_{PWM}$ is applied to an input terminal of a driver controller 1610. A clock signal of fixed frequency is also applied to an input terminal of the driver controller 1610. The driver controller 1610 generates a $V_{DRV}$ from the CLK signal and the $V_{PWM}$. The $V_{DRV}$ is used to drive the switch of a buck converter circuit. The current sense and artificial ramp senses the current at the node LX of the buck converter and detects a voltage Vin, then uses this information to generate $V_{sum}$. The voltage $V_{FB}$ is generated from $v_{out}$ of the buck converter.

Figure 15:
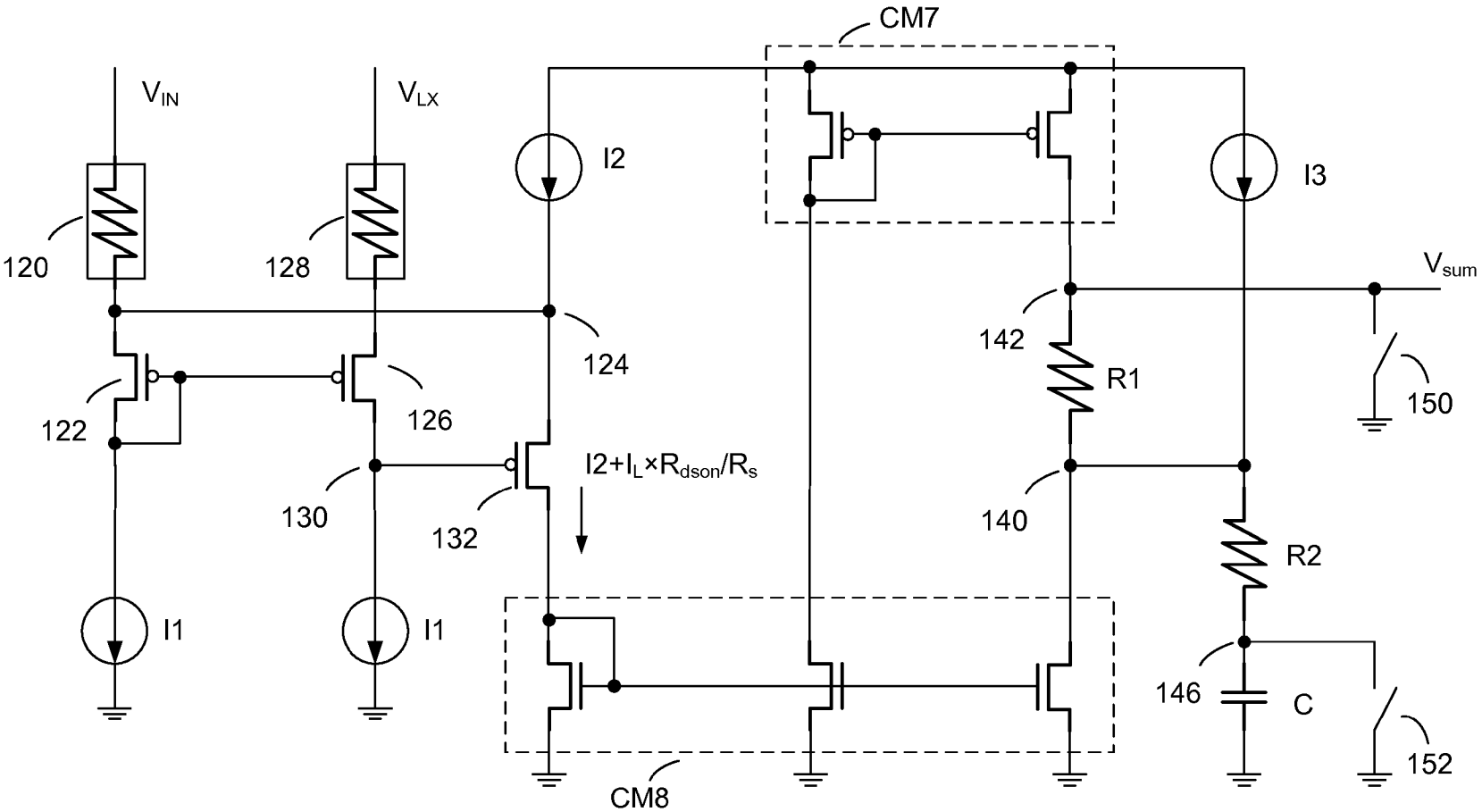
FIG. 15 illustrates a current sense and artificial ramp for a buck converter.

FIG. 15 illustrates a current sense and artificial ramp for a buck converter. The voltage Vin is applied to a terminal of a resistor 120, where the resistor 120 has a resistance of Rs. The other terminal of the resistor 120 is connected to the source terminal of a p-channel MOSFET 122. The source terminal of the MOSFET 122 is also connected with a node 124. The gate of the p-channel MOSFET 122 is connected to its drain. The drain terminal of the p-channel MOSFET 122 is connected to a current source with a current I1, flowing away from the drain terminal of the p-channel MOSFET 122 to the ground. The gate of p-channel MOSFET 122 is connected to the gate of another p-channel MOSFET 126. The source terminal of the p-channel MOSFET 126 is connected to a terminal of a resistor 128 with a resistance of Rs. The voltage $V_{LX}$ is applied to the other terminal of the resistor 128.

The drain terminal of the p-channel MOSFET 126 is connected to a node 130. The node 130 is further connected to a current source with a current I1 flowing away from the node 130 to ground. The node 130 is connected to the gate of a p-channel MOSFET 132. The source terminal of the p-channel MOSFET 132 connects to the node 124. A current source is connected to the node 124 with a current I2 flowing to the node 124.

The drain terminal of the p-channel MOSFET 132 is connected to a first connection terminal of a current mirror CM8. Analyzing the circuit, the from the drain terminal of the p-channel MOSFET 132 can be given by Equation (8). A second connection terminal of the CM8 is connected to another current mirror CM7 via the CM7's first connection terminal. A third connection terminal of the CM8 is connected to a node 140. The node 140 is further connected to a terminal of a resistor R1. The other terminal of the resistor R1 is connected to node 142. The node 142 is connected to a second connection terminal of the CM7. The voltage at node 142 can be denoted $V_{sum}$. The node 142 can be connected to ground via a switch 150, where that switch 150 is driven by a signal $V_{DRVB}$.

The node 140 is connected to a current source providing a current I3, which flows through the node 140. The node 140 connects to one terminal of a resistor R2. R2 is then connected to a node 146. The node 146 can be connected to ground via a switch 152, where that switch 152 is driven by the signal $V_{DRVB}$. The node 146 is also connected to one terminal capacitor C. The other terminal of capacitor C is connected to ground.

Analyzing the circuit, $V_{sum}$ can be given by Equation (7).

Figure 16:
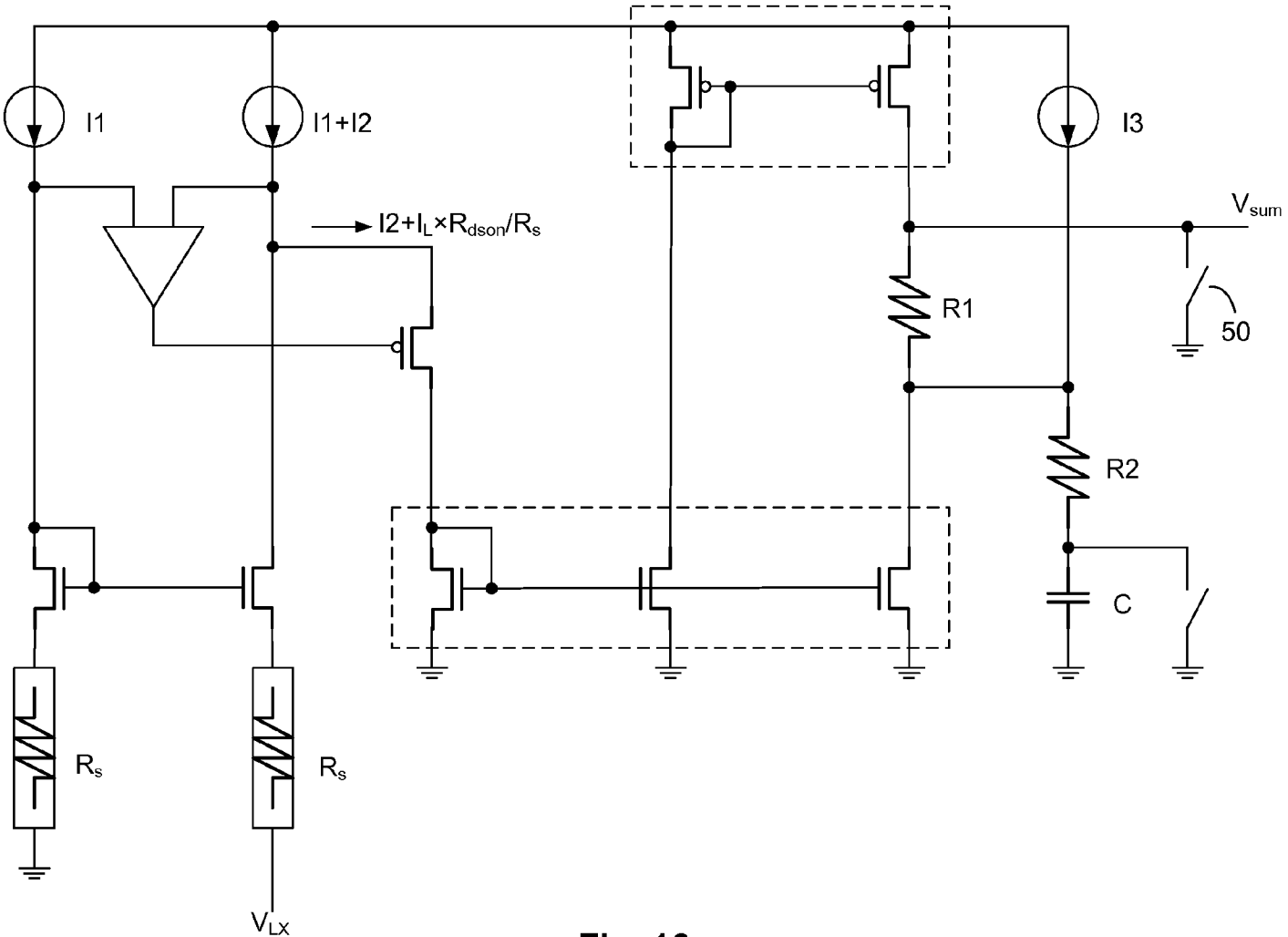
FIG. 16 illustrates a method for optimizing a current sense and artificial ramp circuit.
Figure 17A:
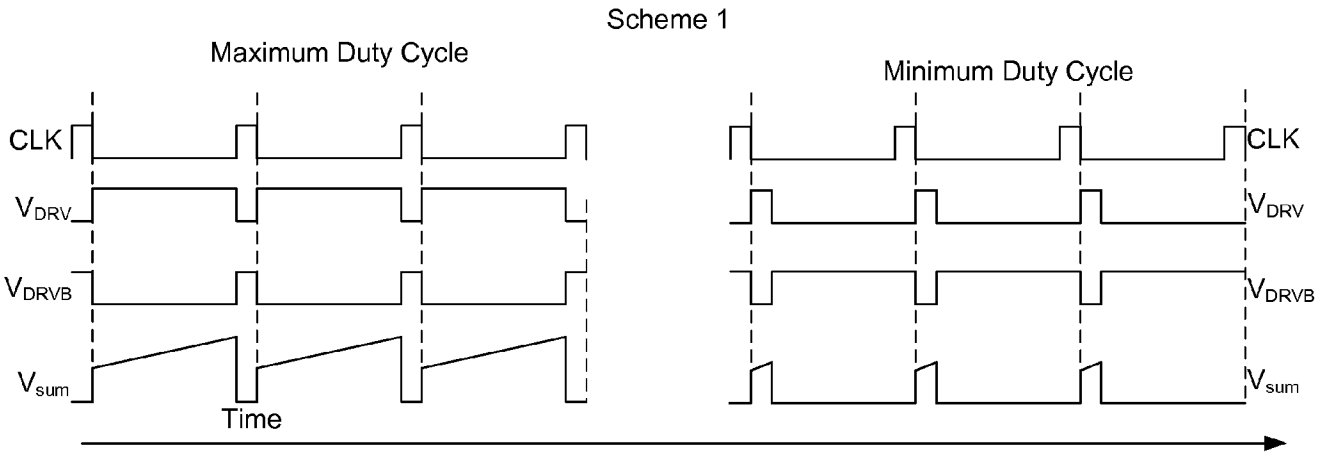
FIGS. 17*a*-17*b* illustrate the relationship between the various signals of an optimized current sense and artificial ramp circuit.

FIG. 16 illustrates an optimization of an embodiment of the present invention. Referring to FIG. 16, a switch 50 is driven by a voltage signal $V_{DRV_oneshot}$ to optimize performance of the current sense and artificial ramp circuit. Usually, I1, I2, I3 are small currents to minimize power consumption. Therefore, the charging of $V_{sum}$ from ground to a fixed voltage is slow. This causes a problem when the duty cycle is small because the slow charging will distort the voltage $V_{sum}$ (see FIG. 17*a*, Minimum Duty Cycle) since the duty cycle is not long enough to artificially ramp up the voltage.

Figure 17B:
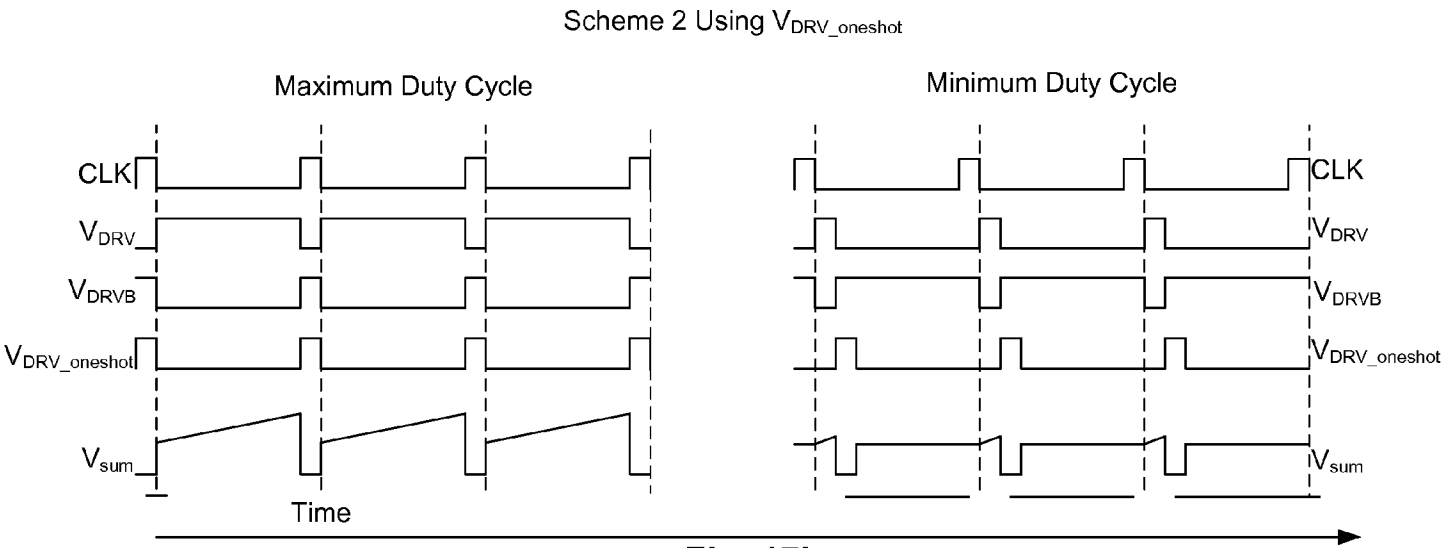

To provide a more accurate $V_{sum}$, this scheme uses a one-shot voltage signal $V_{DRV_oneshot}$, which can be generated when the $V_{DRV}$ signal goes from a high state to a low state (i.e. a negative edge of $V_{DRV}$). When the one-shot voltage signal is activated, then $V_{sum}$ is raised to an offset voltage so that when a high output is triggered for the voltage $V_{sum}$, it requires less time to reach the higher state (see FIG. 17*b*, Minimum Duty Cycle). For instance, $V_{dry\text{-}oneshot}$ can reset $V_{sum}$ to zero. After reset, $V_{sum}$ can be maintained at a fixed offset voltage. After the $V_{drv}$ signal goes to a high state, the $V_{sum}$ the current sense voltage signal and artificial ramp voltage can be added to the fixed offset voltage to generate $V_{sum}$. The duration of $V_{drv_oneshot}$ can be small compared to a clock cycle. The duration can usually be a few nano-seconds, long enough to reset the $V_{sum}$ signal.

The voltage $V_{DRVB}$ signal can still be used to reset the artificial ramp voltage on the capacitor. This principle can be applied to the other embodiments of the present invention by driving one of the switches connected to $V_{sum}$ with the $V_{DRV_oneshot}$ signal.

While the present invention has been described with reference to certain preferred embodiments or methods, it is to be understood that the present invention is not limited to such specific embodiments or methods. Rather, it is the inventor's contention that the invention be understood and construed in its broadest meaning as reflected by the following claims. Thus, these claims are to be understood as incorporating not only the preferred methods described herein but all those other and further alterations and modifications as would be apparent to those of ordinary skilled in the art.

We claim:

1. A current control circuit for a switching power converter, comprising:

a first current mirror;

a second current mirror;

a current sensing circuit, wherein the current sensing circuit outputs a sensed current proportional to a switching current at a node of the switching power converter; and a voltage summing circuit, wherein the voltage summing circuit sums a fixed voltage, a sensed voltage, and an artificial ramp voltage, wherein the sensed current is mirrored by the first current mirror and connected to the second current mirror and the voltage summing circuit, wherein the second current mirror is connected to the voltage summing circuit, and wherein the summed voltage is compared to an error amplified voltage for the switching power converter to generate a pulse width modulation signal to drive the switching of the switching power converter.

2. The current control circuit of claim 1 wherein the switching power converter is a boost converter.

3. The current control circuit of claim 1 wherein the switching power converter is a buck converter.

4. The current control circuit of claim 1 wherein the pulse width modulation signal is inputted to a driver controller, wherein the driver controller generates a first signal as a function of a clock signal and the pulse width modulation signal, and wherein the first signal drives the switching power converter.

5. The current control circuit of claim 1 wherein the current sensing circuit comprises, a first current source;

a second current source;

an operational amplifier having a first input, a second input, and an output;

a first transistor;

a second transistor;

a third transistor;

a first resistor; and a second resistor, wherein the first current source, the first transistor, and the first resistor are connected in series forming a first branch, wherein the second current source, the second transistor, and the second resistor are connected in series forming a second branch, wherein the gate of the second transistor and the drain of the second transistor are connected, wherein the gate of the second transistor and the gate of the first transistor are connected, wherein the first resistor is connected to the node, wherein the first input of the operational amplifier is connected to the first branch and the second input of the operational amplifier is connected to the second branch, wherein the output of the operational amplifier is connected to the gate of the third transistor, wherein the source of the third transistor is connected to the first branch, and wherein the drain of the third transistor is connected to the first current mirror.

6. The current control circuit of claim 1 wherein the voltage summing circuit comprises, a third current source;

a third resistor;

a fourth resistor; and a capacitor, wherein the third resistor, the fourth resistor, and the capacitor are connected in series, wherein a first end of the third resistor is connected to the second current mirror, and wherein a second end of the third resistor is connected to the third current source, the first current mirror, and a first end of the fourth resistor.

7. The current control circuit of claim 1 wherein the current sensing circuit comprises, a first current source;

a second current source;

a third current source;

a first transistor;

a second transistor;

a third transistor;

a first resistor; and a second resistor, wherein the first current source, the first transistor, and the first resistor are connected in series forming a first branch, wherein the second current source, the second transistor, and the second resistor are connected in series forming a second branch, wherein the gate of the second transistor and the drain of the second transistor are connected, wherein the gate of the second transistor and the gate of the first transistor are connected, wherein the first resistor is connected to the node, wherein the third transistor and the third current source are connected in series, wherein the drain of the third transistor is connected to the first current mirror, wherein the source of the third transistor is connected to the second branch and to the third current source, and wherein the gate of the third transistor is connected to the drain of the first transistor.

8. The current control circuit of claim 4 further comprising a switch, wherein the switch resets the summed voltage to zero as a function of the first signal.

9. The current control circuit of claim 8 wherein, after the summed voltage is reset to zero, the summed voltage is maintained at an offset voltage for a predefined duration of time.

10. The current control circuit of claim 9 wherein, when the first signal goes to a high state, the summed voltage is the sum of the offset voltage, the fixed voltage, the sensed voltage, and the artificial ramp voltage.

11. The current control circuit of claim 5 wherein the first resistor is a first plurality of transistors serially connected from drain to source, and the gates of each of the first plurality of transistors are connected, and wherein the second resistor is a second plurality of transistors serially connected from drain to source, and the gates of each of the second plurality of transistors are connected.

12. The current control circuit of claim 5 wherein the first transistor is an n-channel metal oxide semiconductor field effect transistor ("MOSFET"), wherein the second transistor is an n-channel MOSFET, and wherein the third transistor is a p-channel MOSFET.

13. The current control circuit of claim 6 wherein the voltage summing circuit further comprising, a first switch connected to the first end of the third resistor; and a second switch connected to a second end of the fourth resistor and a first end of the capacitor.

14. The current control circuit of claim 7 wherein the first resistor is a first plurality of transistors serially connected from drain to source, and the gates of each of the first plurality of transistors are connected, and wherein the second resistor is a second plurality of transistors serially connected from drain to source, and the gates of each of the second plurality of transistors are connected.

15. The current control circuit of claim 7 wherein the first transistor, the second transistor, and the third transistor are n-channel metal oxide semiconductor field effect transistors.

16. The current control circuit of claim 7 wherein the first transistor, the second transistor, and the third transistor are p-channel metal oxide semiconductor field effect transistors.

17. A current control circuit for a switching power converter, comprising:

a first current mirror;

a second current mirror;

a current sensing circuit, wherein the current sensing circuit outputs a sensed current proportional to a switching current at a node of the switching power converter; and a voltage summing circuit, wherein the voltage summing circuit sums a fixed voltage, a sensed voltage, and an artificial ramp voltage, wherein the sensed current is mirrored by the first current mirror and connected to the second current mirror and the voltage summing circuit, wherein the second current mirror is connected to the voltage summing circuit, wherein the summed voltage is compared to an error amplified voltage for the switching power converter to generate a pulse width modulation signal to drive the switching of the switching power converter, wherein the pulse width modulation signal is inputted to a driver controller, wherein the driver controller generates a first signal as a function of a clock signal and the pulse width modulation signal, and wherein the first signal drives the switching power converter.

18. The current control circuit of claim 17 wherein the current sensing circuit comprises, a first current source;

a second current source;

an operational amplifier having a first input, a second input, and an output;

a first transistor, wherein the first transistor is an n-channel metal oxide semiconductor field effect transistor ("MOSFET");

a second transistor, wherein the second transistor is an n-channel MOSFET;

a third transistor, wherein the third transistor is a p-channel MOSFET;

a first resistor, wherein the first resistor is a first plurality of transistors serially connected from drain to source and the gates of each of the first plurality of transistors are connected; and a second resistor, wherein the second resistor is a second plurality of transistors serially connected from drain to source and wherein the gates of each of the second plurality of transistors are connected, wherein the first current source, the first transistor, and the first resistor are connected in series forming a first branch, wherein the second current source, the second transistor, and the second resistor are connected in series forming a second branch, wherein the gate of the second transistor and the drain of the second transistor are connected, wherein the gate of the second transistor and the gate of the first transistor are connected, wherein the first resistor is connected to the node, wherein the first input of the operational amplifier is connected to the first branch and the second input of the operational amplifier is connected to the second branch, wherein the output of the operational amplifier is connected to the gate of the third transistor, wherein the source of the third transistor is connected to the first branch, and wherein the drain of the third transistor is connected to the first current mirror.

19. The current control circuit of claim 18 wherein the voltage summing circuit comprises, a third current source;

a third resistor;

a fourth resistor;

a capacitor;

a first switch connected to the first end of the third resistor; and a second switch connected to a second end of the fourth resistor and a first end of the capacitor, wherein the third resistor, the fourth resistor, and the capacitor are connected in series, wherein a first end of the third resistor is connected to the second current mirror, wherein a second end of the third resistor is connected to the third current source, the first current mirror, and a first end of the fourth resistor, wherein the first switch resets the summed voltage to zero as a function of the first signal, wherein, after the summed voltage is reset, the summed voltage is maintained at an offset voltage for a predefined duration of time, and wherein, when the first signal goes to a high state, the summed voltage is the sum of the offset voltage, the fixed voltage, the sensed voltage, and the artificial ramp voltage.

20. A current control circuit for a switching power converter, comprising:

a first current mirror;

a second current mirror;

a current sensing circuit, wherein the current sensing circuit outputs a sensed current proportional to a switching current at a node of the switching power converter; and a voltage summing circuit, wherein the voltage summing circuit sums a fixed voltage, a sensed voltage, and an artificial ramp voltage, wherein the first transistor, the second transistor, and the third transistor are the same channel metal oxide semiconductor field effect transistors, wherein the sensed current is mirrored by the first current mirror and connected to the second current mirror and the voltage summing circuit, wherein the second current mirror is connected to the voltage summing circuit, wherein the summed voltage is compared to an error amplified voltage for the switching power converter to generate a pulse width modulation signal to drive the switching of the switching power converter, wherein the pulse width modulation signal is inputted to a driver controller, wherein the driver controller generates a first signal as a function of a clock signal and the pulse width modulation signal, wherein the first signal drives the switching power converter, and wherein the current sensing circuit comprises, a first current source;

a second current source;

a third current source;

a first transistor;

a second transistor;

a third transistor;

a first resistor, wherein the first resistor is a first plurality of transistors serially connected from drain to source and the gates of each of the first plurality of transistors are connected; and a second resistor, wherein the second resistor is a second plurality of transistors serially connected from drain to source and wherein the gates of each of the second plurality of transistors are connected, wherein the first current source, the first transistor, and the first resistor are connected in series forming a first branch, wherein the second current source, the second transistor, and the second resistor connected in series forming a second branch, wherein the gate of the second transistor and the drain of the second transistor are connected, wherein the gate of the second transistor and the gate of the first transistor are connected, wherein the first resistor is connected to the node, wherein the third transistor and the third current source are connected in series, wherein the drain of the third transistor is connected to the first current mirror, wherein the source of the third transistor is connected to the second branch and to the third current source, and wherein the gate of the third transistor is connected to the drain of the first transistor.

* * * * *